US005707792A

United States Patent [19]

Yamada et al.

[11] Patent Number: 5,707,792

[45] Date of Patent: Jan. 13, 1998

[54] SILVER HALIDE PHOTOGRAPHIC LIGHT SENSITIVE MATERIAL

[75] Inventors: Taketoshi Yamada; Norio Miura; Emiko Kataoka; Katsunori Katoh, all of Hino, Japan

[73] Assignee: Konica Corporation, Japan

[21] Appl. No.: 791,377

[22] Filed: Jan. 30, 1997

[30] Foreign Application Priority Data

Feb. 9, 1996 [JP] Japan ..... 8-023882
Sep. 18, 1996 [JP] Japan ..... 8-245989

[51] Int. Cl.[6] ..... G03C 1/40

[52] U.S. Cl. ..... 430/561; 430/390; 430/559; 430/562; 430/563

[58] Field of Search ..... 430/390, 559, 430/561, 562, 563

[56] References Cited

FOREIGN PATENT DOCUMENTS 0616898 9/1994 European Pat. Off. .
0617320 9/1994 European Pat. Off. .
753888 2/1995 Japan .
2004380 9/1978 United Kingdom .

*Primary Examiner*—Hoa Van Le
*Attorney, Agent, or Firm*—Jordan B. Bierman; Bierman, Muserlian and Lucas

[57] ABSTRACT

A silver halide photographic light sensitive material is disclosed, comprising a support having thereon photographic component layers including a silver halide emulsion layer and a light insensitive hydrophilic colloidal layer, wherein at least one of the component layers contains a leuco dye represented by the following formula.

8 Claims, No Drawings

SILVER HALIDE PHOTOGRAPHIC LIGHT SENSITIVE MATERIAL

FIELD OF THE INVENTION

The present invention relates a silver halide black-and-white photographic light sensitive material containing a noble leuco dye, improving its storage stability and providing a blue-black toned silver image.

BACKGROUND OF THE INVENTION

Recently, in the processing of silver halide photographic light sensitive materials, there has been strong demand for shortening of the processing time and reduction of processing effluent.

For shortening the processing time, it has been considered to be advantageous to use a silver chlorobromide or silver chloride emulsion having a higher solubility than a silver iodobromide emulsion, and to make silver halide grains small size or tabular form.

To reduce the processing effluent amount is required enhancement of developability, so that silver halide grains with high covering power which are capable of providing high density with minimal silver coverage, are desirable. It is well known that tabular silver halide grains are preferred in terms of sensitivity, graininess, sharpness and spectral sensitization efficiency.

However, reduction of grain size and thickness results in an increase of scattering of a blue light component due to developed silver, giving rise to a yellowish silver image.

Regarding this phenomenon, it is known that the silver image tends to become yellowish in cases when fine grain emulsions (e.g., average grain size of 0.4 μm or less) or tabular grains with thin grain thickness (e.g., grain thickness of 0.4 μm or less) are employed and, in particular, when the silver iodide content is decreased or the silver chloride content is increased.

With regard to techniques for improving the silver image tone, a variety of studies have been reported concerning photographic light sensitive materials and processing thereof, in which a specific mercapto compound, for example, is well-known as a toning agent. Recently, there was proposed a technique in which a specific dye is incorporated in a photographic material, through solution in a water-insoluble high boiling organic solvent and dispersion in water in the form of fine particles, as disclosed in JP-A 5-165147 (hereinafter, the term, "JP-A" is referred to as an unexamined and published Japanese Patent Application). However, this resulted in variations in sensitivity after storage prior to exposure. Specifically, in medical X-ray photographic materials, there was a problem in that smudge would stick to the intensifying screen, when it was brought into contact with the photographic material at the time of exposure. Furthermore, in the prior art, there was also a defect in that unexposed portions contained the same amount of dye as exposed portions, resulting in an increase in fog density. To overcome this defect, a technique was proposed, in which, in response to silver image formation, a dye image is formed by a diffusion-proof compound capable of releasing a diffusible dye upon interaction with silver ions, as disclosed in JP-A 3-157645. However, the resulting image was proved to be insufficient for improvement in black density and reduction of fog. On the other hand, there is proposed a technique of using a leuco dye capable of providing a blue image corresponding to the silver image, as disclosed in JP-A 3-153234. Although smudging of a developer and occurrence of color stain would be restrained by the prior art, the blue dye image formed with the leuco dye, described in the patent application, has color in the long wavelength region and with a green-tinged tone, so that effect on the improvement in blackness of the silver image was insufficient. Furthermore, there was the defect that the residue of the leuco dye in unexposed portions of the processed photographic material is likely to discolor over time and cause an fog-increase.

SUMMARY OF THE INVENTION

Accordingly, an objective of the present invention is to provide a novel leuco dye. Another objective concerns a silver halide photographic light sensitive material which is capable of rapidly processing and providing a neutral black or blue-black toned silver image, and also its image forming method and processing method. A further objective concerns a silver halide photographic light sensitive material which prevents smudging of the intensifying screen and developer, and its image forming method and processing method. Furthermore, another objective concerns a silver halide photographic light sensitive material with little variation of photographic performance over time, and its image forming method and processing method.

The above objectives of the invention can be accomplished by the following constitution.

(1) A leuco dye represented by the following formula:

Formula (1)

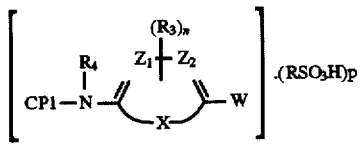

In the formula, W is $—NR_1R_2$, —OH or —OZ, in which $R_1$ and $R_2$ each are an alkyl group or an aryl group and Z is an alkali metal ion or a quaternary ammonium ion. $R_3$ is a hydrogen atom, a halogen atom or a univalent substituent and n is an integer of 1 to 3. $Z_1$ and $Z_2$ each are a nitrogen atom or $=C(R_3)—$. X is an atomic group necessary for forming a 5- or 6-membered aromatic heterocyclic ring with $Z_1$, $Z_2$ and carbon atoms adjoining thereto. $R_4$ is a hydrogen atom, an acyl group, a sulfonyl group, carbamoyl group, sulfo group, sulfamoyl group, an alkoxycarbonyl group, or aryoxycarbonyl group. R is an aliphatic group or an aromatic group. p is an integer of 1 or 2. CP1 represents the following groups:

CP1

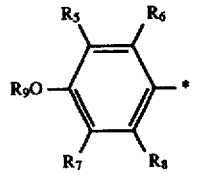

-continued

CP1

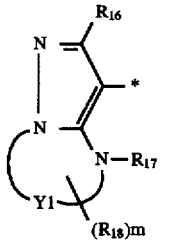

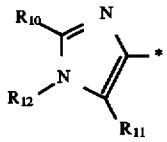

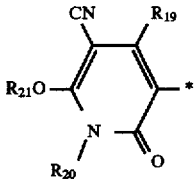

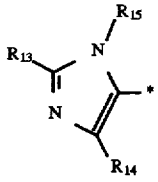

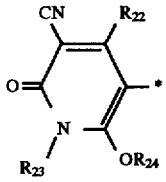

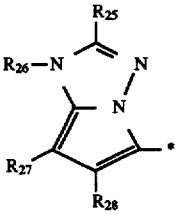

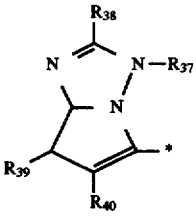

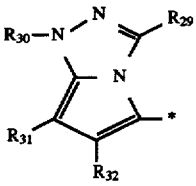

-continued

CP1

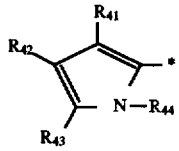

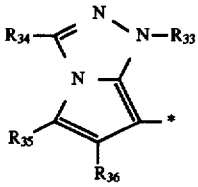

In the formula, $R_5$ through $R_8$ each are a hydrogen atom, a halogen atom or a substituent for a benzene ring, provided that $R_5$ and $R_6$, or $R_7$ and $R_8$ may be linked with each other to form a 5 to 7-membered ring. $R_9$ has the same definition as $R_4$. $R_{10}$ and $R_{11}$ each are an alkyl group, an aryl group or a heterocyclic group. $R_{12}$ has the same definition as $R_4$. $R_{13}$ and $R_{14}$ each have the same definition of $R_{10}$ and $R_{11}$. $R_{15}$ has the same definition as $R_{12}$. $R_{16}$ is an alkyl group, an aryl group, a sulfonyl group, a trifluoromethyl group, a carboxy group, an aryloxycarbonyl group, an alkoxycarbonyl group, a carbamoyl group or a cyano group. $R_{17}$ has the same definition as $R_4$. $R_{18}$ has the same definition as $R_3$ and m is an integer of 1 to 3. Y1 is an atomic group necessary for forming 5- or 6-membered nitrogen containing monocyclic or condensed ring together with two nitrogen atoms. $R_{19}$ and $R_{20}$ each are an alkyl group or an aryl group. $R_{21}$ has the same definition as $R_4$. $R_{22}$ and $R_{23}$ each have the same definition as $R_{19}$ and $R_{20}$. $R_{24}$ has the same definition as $R_{21}$. $R_{25}$, $R_{27}$ and $R_{28}$ each are a hydrogen atom or a substituent. $R_{26}$ has the same definition as $R_4$. $R_{29}$, $R_{31}$ and $R_{32}$ each have the same definition as $R_{25}$, $R_{27}$ and $R_{28}$. $R_{30}$ has the same definition as $R_{26}$. $R_{34}$, $R_{35}$ and $R_{36}$ each have the same definition as $R_{25}$, $R_{27}$ and $R_{28}$. $R_{33}$ has the same definition as $R_{26}$. $R_{38}$, $R_{39}$ and $R_{40}$ each have the same definition as $R_{25}$, $R_{27}$ and $R_{28}$. $R_{37}$ has the same definition as $R_{26}$. $R_{41}$, $R_{42}$ and $R_{43}$ each have the same definition as $R_{25}$, $R_{27}$ and $R_{28}$. $R_{44}$ has the same definition as $R_{26}$. The symbol, "★" represents a bonding site of CP1 with the other moiety.

(2) A silver halide photographic light sensitive material, characterized in that said photographic material contains a compound represented by above-described formula (1).

(3) The silver halide photographic light sensitive material described in above (2), characterized in that said compound represented by formula (1) is represented by the following formula (2):

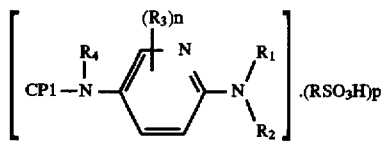

Formula (2)

In the formula, $R_1$, $R_2$, $R_3$, and $R_4$, CP1, n, R and p each have the same definitions as those of $R_1$, $R_2$, $R_3$ and $R_4$, CP1, n, R and p in formula (1).

(4) A silver halide photographic light sensitive material, characterized in that said photographic material contains a compound represented by the following formula (3) and a compound represented by $RSO_3H$:

Formula (3)

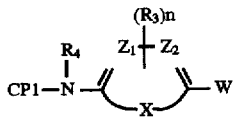

In the formula, $R_3$, n, $R_4$, W, X, $Z_1$, $Z_2$ and CP1 each have the same definitions as those of $R_3$, n, $R_4$, W, X, $Z_1$, $Z_2$ and CP1 in the above (1), respectively. R has the same definition as in formula (1).

(5) The silver halide photographic light sensitive material described in (4), characterized in that said compound represented by formula (3) is represented by formula (4):

Formula (4)

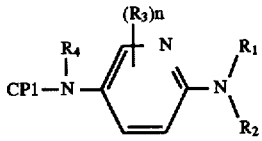

In the formula, $R_1$, $R_2$, $R_3$, $R_4$, CP1 and n each have the same definition as those of $R_1$, $R_2$, $R_3$, $R_4$, CP1 and n in formula (1), respectively.

(6) The silver halide photographic light sensitive material described in above (2) through (5), characterized in that, in the compound represented by formula (1) through (4), at least one of $R_4$, $R_9$, $R_{12}$, $R_{15}$, $R_{17}$, $R_{21}$, $R_{24}$, $R_{26}$, $R_{30}$, $R_{33}$, $R_{37}$ and $R_{44}$ is substituted by at least one selected from the group consisting of —COOM and —$SO_3M^2$, in which $M^1$ and $M^2$ each are a hydrogen atom or an alkali metal atom.

(7) The silver halide photographic light sensitive material described in above (2) through (6), characterized in that said photographic material comprises a support having thereon a silver halide emulsion layer and a light insensitive hydrophilic colloidal layer, in which said silver halide emulsion layer contains silver halide grains having an average silver iodide content of 1 mol % or less, 50% or more of the total grain projected area being accounted for by tabular grains having an aspect ratio of 2 to 20.

(8) The silver halide photographic light sensitive material described in above (2) through (7), characterized in that at least one of compounds represented by formulas (1) through (4) is contained in an amount of $1\times10^{-6}$ to $5\times10^{-1}$ mol per mol of silver.

(9) The silver halide photographic light sensitive material described in above (2) through (8), characterized in that said tabular grains have two parallel (100) major faces and an average silver chloride content of 20 to 100 mol %.

(10) The silver halide photographic light sensitive material described in above (2) through (9), characterized in that said silver halide emulsion is chemically sensitized with a selenium compound or tellurium compound.

(11) The silver halide photographic light sensitive material described in above (2) through (10), characterized in that the amount of hydrophilic binder on the support is not less than 1.0 g/m$^2$ and not more than 3.0 g/m$^2$.

(12) A method for processing the silver halide photographic light sensitive material described in above (2) through (11).

(13) A processing method, characterized in that the silver halide photographic light sensitive material described in above (2) through (11) is processed by an automatic processor within a total time of 10 to 30 sec.

(14) A processing method, characterized in that the silver halide photographic light sensitive material described in above (2) through (11) is processed by an automatic processor at a developer replenishing rate of not less than 30 ml/m$^2$ and not more than 200 ml/m$^2$.

DETAILED DESCRIPTION OF THE INVENTION

In formulas (1) through (4), an alkyl group represented by $R_1$ and $R_2$ preferably includes a methyl group, ethyl group, propyl group and butyl group, which may be substituted. Preferred examples of the substituent include hydroxy group and sulfonamido group.

An aryl group represented by $R_1$ and $R_2$ preferably includes a phenyl group.

The univalent substituent represented by $R_3$ includes an alkyl group (e.g., methyl, ethyl, isopropyl, hydroxyethyl, methoxyethyl, trifluoromethyl, t-butyl, etc.), cycloalkyl group (e.g., cyclopentyl, cyclohexyl, etc.), aralkyl group (e.g., benzyl, 2-phenethyl, etc.), aryl group (e.g., phenyl, naphthyl, p-tolyl, p-chlorophenyl, etc.), alkoxy group (e.g., methoxy, ethoxy, isopropoxy, n-butoxy, etc.), aryloxy group (e.g., phenoxy, etc.), cyano group, acylamino group (e.g., acetylamino, propionylamino, etc.), alkylthio group (e.g., methylthio, ethylthio, n-butylthio, etc.), arylthio group (e.g., phenylthio etc.), sulfonylamino group (e.g., methanesulfonylamino, benzenesulfonylamino, etc.), ureido group (e.g., 3-methylureido, 3,3-dimethylureido, 1,3-dimethylureido, etc.), sulfamoylamino group (e.g., dimethylsulfamoylamino, etc.), carbamoyl group (e.g., methylcarbamoyl, ethylcarbamoyl, dimethylcarbamoyl, etc.), sulfamoyl group (e.g., ethylsulfamoyl, dimethylsulfamoyl, etc.), alkoxycarbonyl group (e.g., methoxycarbonyl, ethoxycarbonyl, etc.), aryloxycarbonyl group (e.g., pheoxycarbonyl, etc.), sulfonyl group (e.g., methanesulfonyl, butanesulfonyl, phenylsulfonyl, etc.), acyl group (e.g., acetyl, propanoyl, butyloyl, etc.), amino group (e.g., methylamino, ethylamino, dimethylamino, etc.), hydroxy group, nitro group, imido group (e.g., phthalimido, etc.), and heterocyclic group (e.g., pyridyl, benzimidazolyl, benzthiazolyl, benzoxazolyl, etc.).

Regarding $R_4$, the acyl group preferably includes an acetyl group, trifluoroacetyl group and benzoyl group. The sulfonyl group preferably includes a methanesulfonyl group and benzenesulfonyl group. The carbamoyl group preferably includes a diethylcarbamoyl group and phenyl carbamoyl group. The sulfamoyl group preferably includes a diethylsulfamoyl group. The alkoxycarbonyl group preferably includes a methoxycarbonyl group and ethoxycarbonyl group. The aryoxycarbonyl group preferably includes a phenoxycarbonyl group.

Regarding Z, the alkali metal includes sodium and potassium. The quaternary ammonium is an ammonium having a total carbon atoms of 8 or less, including trimethylbenzylammonium, tetrabutylammonium and tetradecylammonium.

Examples of the 5- or 6-membered aromatic heterocyclic ring formed with X, Z1, $Z_2$ and carbon atoms adjoining thereto include a pyridine ring, pyridazine ring, pyrazine ring, triazine ring, tetrazine ring, pyrrol ring, furan ring, thiophene ring, thiazole ring, oxazole ring, imidazole ring, thiadiazole ring, and oxadiazole ring. Among these, the pyridine ring is preferred.

As the substituents for a benzene ring represented by $R_5$ through $R_8$ are cited the same as those of the univalent substituent represented by $R_3$. Among these are preferred an alkyl group and acylamino group. The 5- to 7-membered ring formed by a combination of $R_5$ and $R_6$, or $R_7$ and $R_8$ includes an aromatic hydrocarbon ring and heterocyclic ring, preferably, benzene ring.

Regarding $R_{10}$ and $R_{11}$, examples of the alkyl group include methyl, ethyl, propyl and butyl. Examples of the aryl group include a phenyl group and naphthyl group. As the heterocyclic group is cited an aromatic heterocyclic ring containing at least one of O, S and N, e.g., 6-membered azine ring, such as pyridine, pyrazine and pyrimidine, and its benzelogue (i.e., analogue which is condensed with a benzene nucleus); pyrrol, thiophene and furan, and their benzelogue; 5-membered azole ring, such as imidazole, pyrazole, triazole, tetrazole, thiazole, oxazole, thiadiazole and oxadiazole, and its benzelogue. $R_{10}$ and $R_{11}$ are preferably a phenyl group, pyrazolyl group and pyridyl group. (herein, the term "benzelogue" means Regarding $R_{16}$, examples of the alkyl group include a methyl group, isopropyl group, pentyl group and t-butyl group. The aryl group includes a phenyl group, naphthyl group and so forth. The sulfonyl group includes a methanesulfonyl group, benzenesulfonyl group and so forth. The aryloxycarbonyl group includes a phenoxycarbonyl group and so forth. The alkoxycarbonyl group includes an ethoxycarbonyl group and so forth. The carbamoyl group includes a diethylaminocarbamoyl group and so forth.

Examples of the nitrogen-containing heterocyclic ring represented by Y1 include imidazole, triazole and tetrazole rings and their benzo-condensed rings.

Regarding $R_{19}$ and $R_{20}$, examples of the alkyl group include a methyl group, pentyl group, t-butyl group and so forth. examples of the aryl group include a phenyl group, naphthyl group and so forth.

The substituent represented by $T_{25}$, $R_{27}$ or $R_{28}$ includes a phenyl group, methyl group, benzoyl group, phenoxy group, ethoxy group and so forth.

Examples of the aliphatic group represented by R include a hexyl group, dodecyl group and so forth. The aromatic group includes p-toluene, dodecylbenzene, and so forth.

Exemplary Examples of the compounds represented formulas (1) through (4) [including examples of CP1 moiety, residual moiety (denoted as CD), $RSO_3H$, and compounds comprised thereof (Table 1)] are shown as below, but the invention is not limited thereto.

CP-1

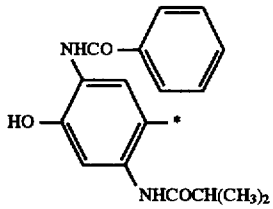

CP-2

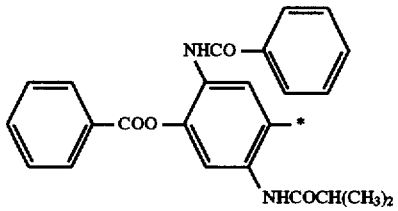

CP-3

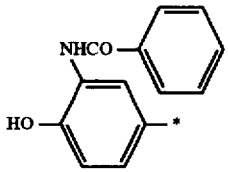

CP-4

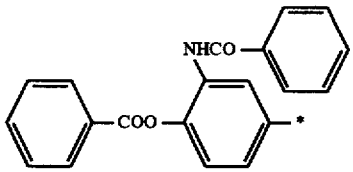

CP-5

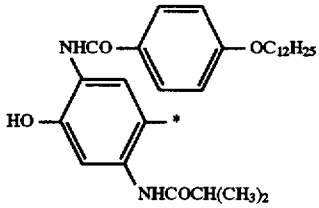

-continued
CP-6
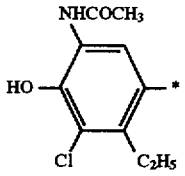
CP-7
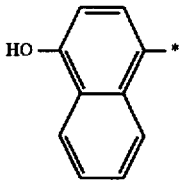
CP-8
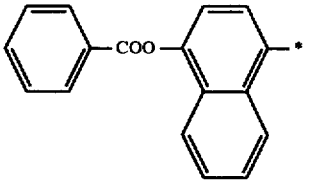
CP-9
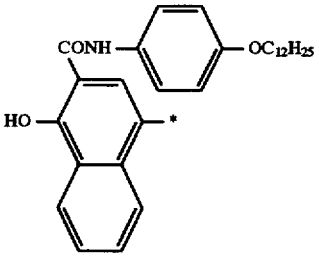
CP-10
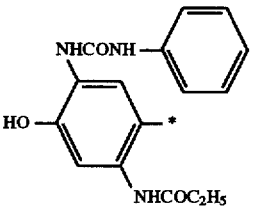
CP-11
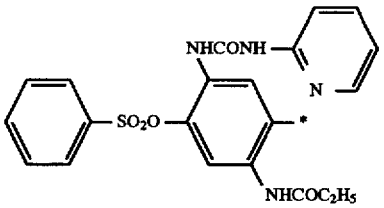
CP-12
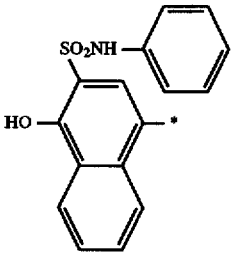
CP-13
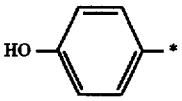

-continued
CP-14
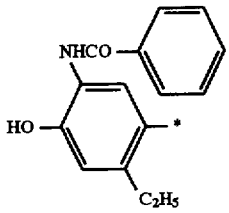
CP-15
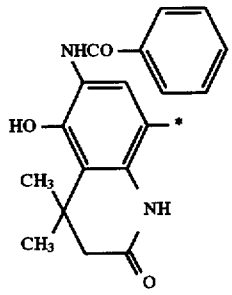
CP-16
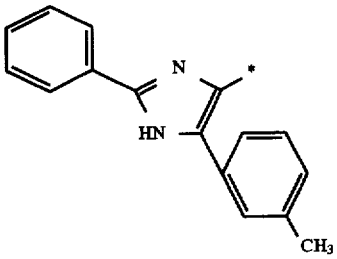
CP-17
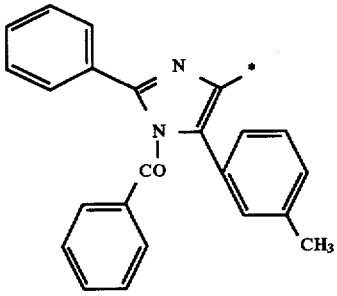
CP-18
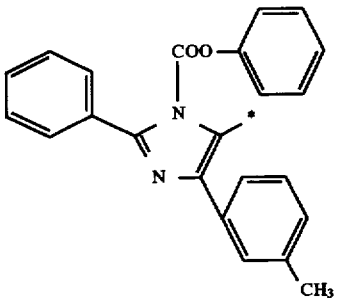
CP-19
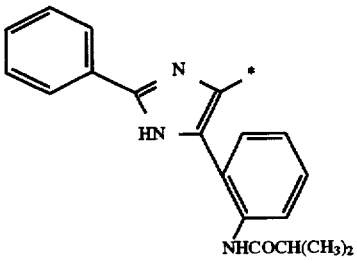

-continued
CP-20
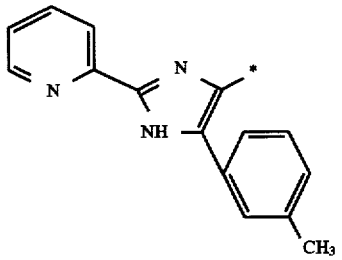
CP-21
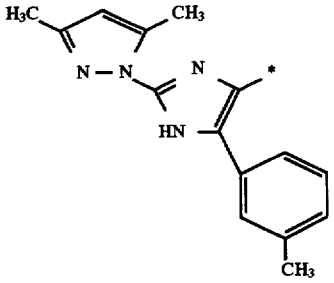
CP-22
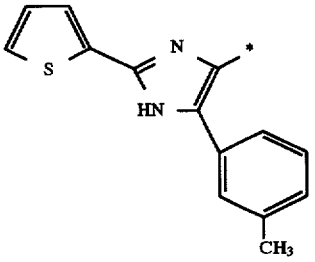
CP-23
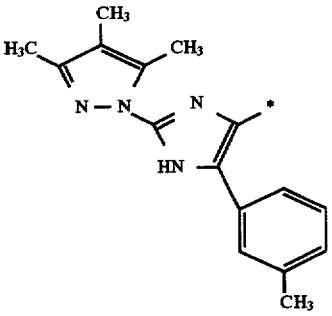
CP-24
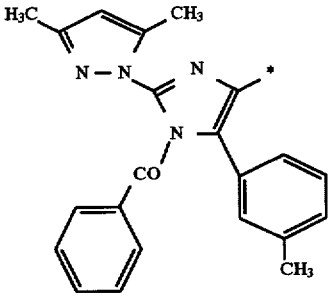

-continued
CP-25
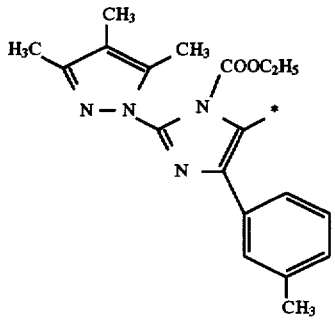
CP-26
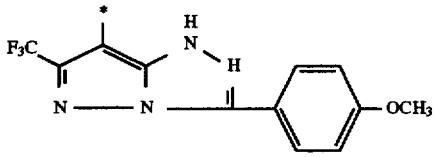
CP-27
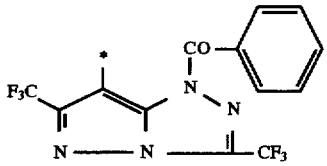
CP-28
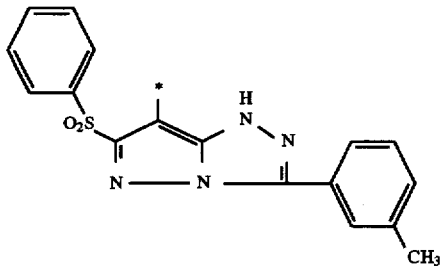
CP-29
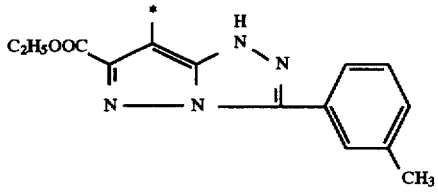
CP-30
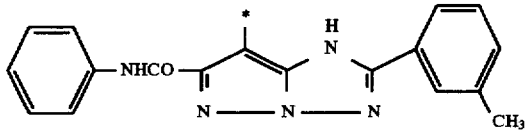
CP-31
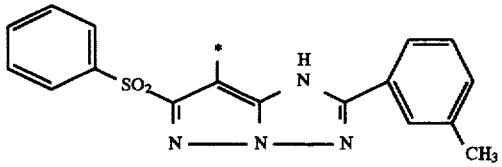
CP-32
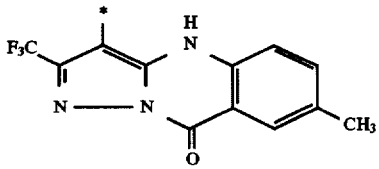

-continued
CP-33
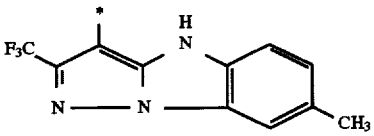
CP-34
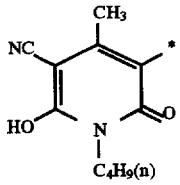
CP-35
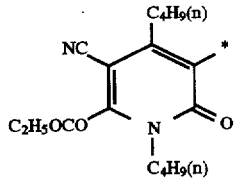
CP-36
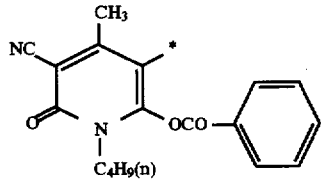
CP-37
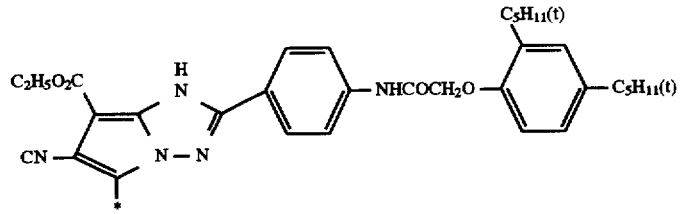
CP-38
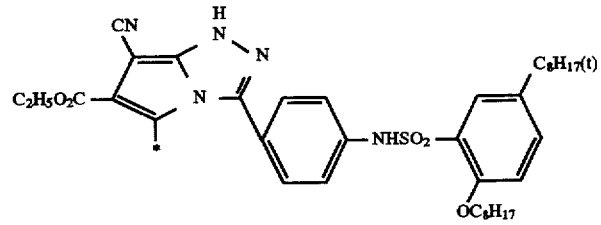
CP-39
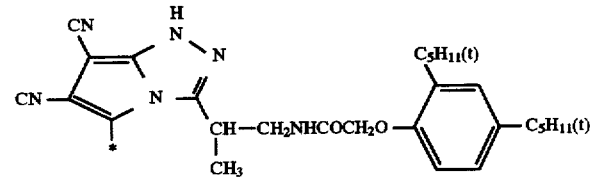
CP-40
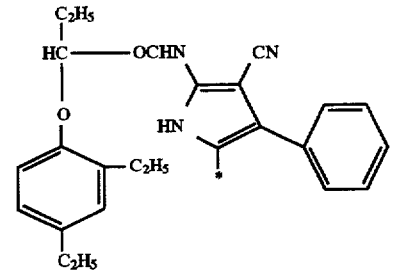

-continued
CP-41
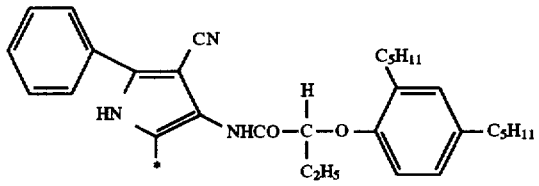
CP-42
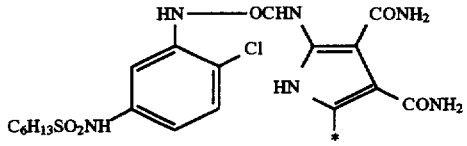
CP-43
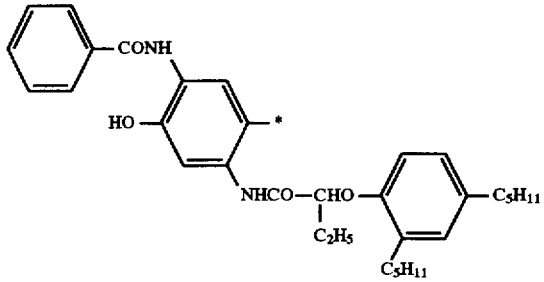
CP-44
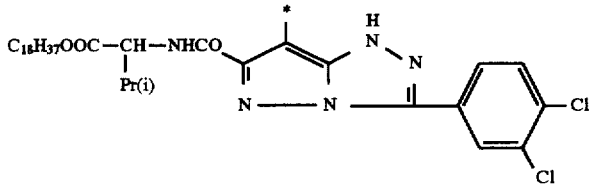
CD
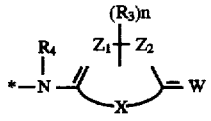
CD-1
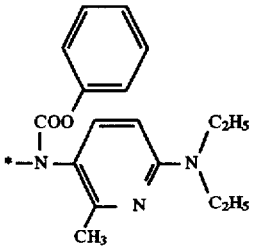
CD-2
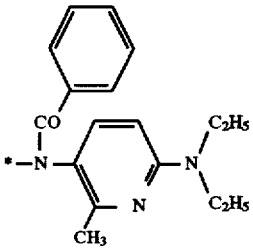

-continued
CD-3
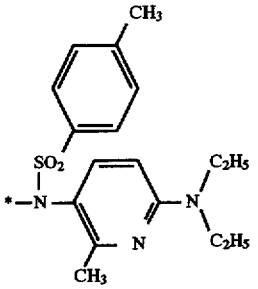
CD-4
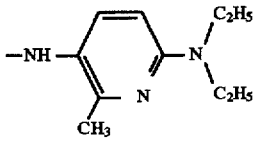
CD-5
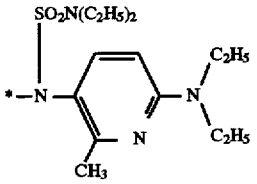
CD-6
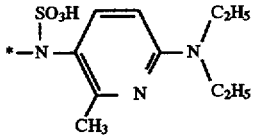
CD-7
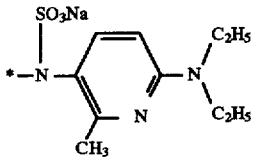
CD-8
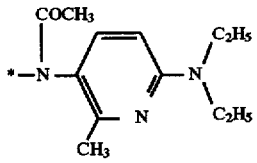
CD-9
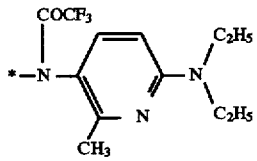
CD-10
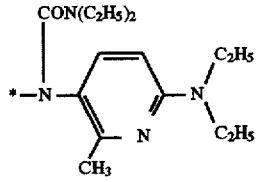

-continued
CD-11
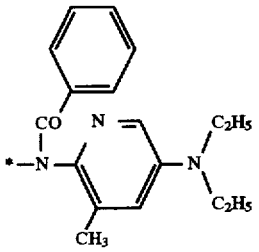
CD-12
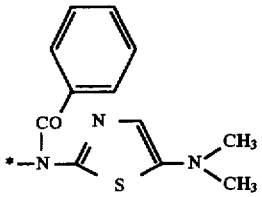
CD-13
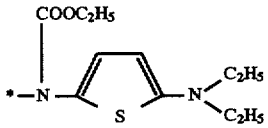
CD-14
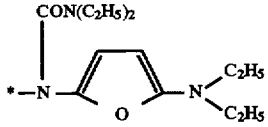
CD-15
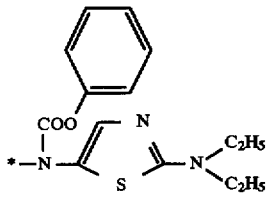
CD-16
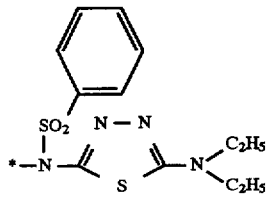
CD-17
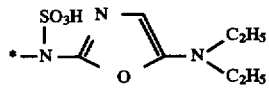
CD-18
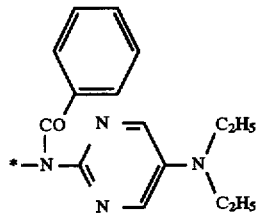
CD-19
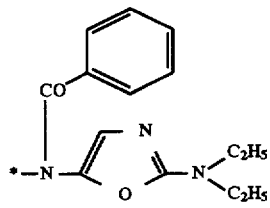

-continued
CD-20
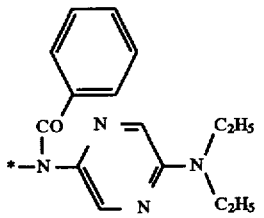
CD-21
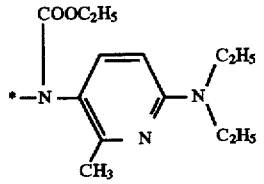
CD-22
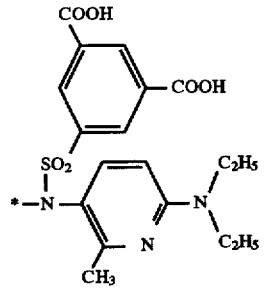
CD-23
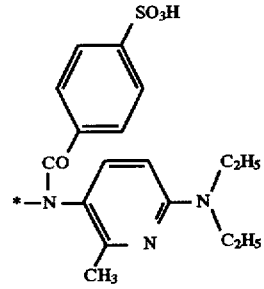
CD-24
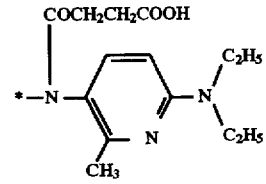
CD-25
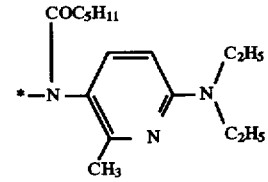

-continued
CD-26
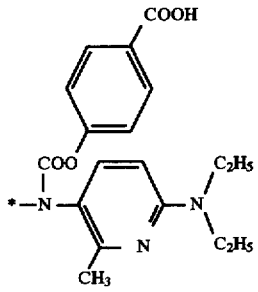
CD-27
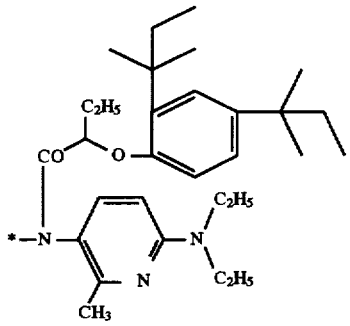
CD-28
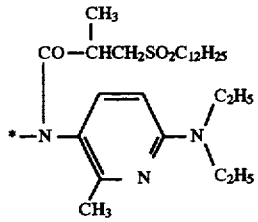
CD-29
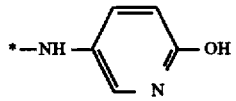
CD-30
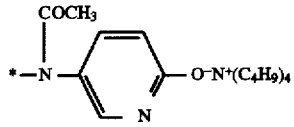
$(RSO_3H)_p$
a)
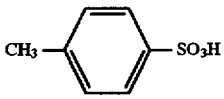
b)
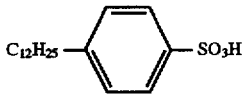
c)
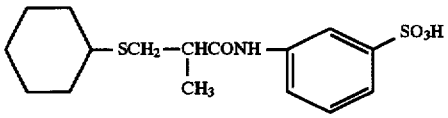
d)
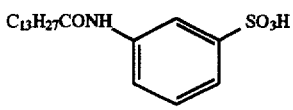

-continued e) 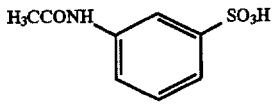

f) $C_{12}H_{25}SO_3H$

TABLE 1

| | | | CP1-CD.(RSO$_3$H) | | | | |
|---|---|---|---|---|---|---|---|
| No. | CP1 | CD | RSO$_3$H | No. | CP1 | CD | RSO$_3$H |
| 1 | 1 | 1 | | 40 | 26 | 15 | |
| 2 | 1 | 2 | | 41 | 26 | 19 | |
| 3 | 1 | 3 | | 42 | 33 | 2 | |
| 4 | 1 | 4 | | 43 | 33 | 10 | |
| 5 | 1 | 5 | | 44 | 33 | 14 | |
| 6 | 1 | 6 | | 45 | 33 | 16 | |
| 7 | 1 | 7 | | 46 | 34 | 2 | |
| 8 | 1 | 8 | | 47 | 34 | 5 | |
| 9 | 1 | 9 | | 48 | 35 | 17 | |
| 10 | 1 | 10 | | 49 | 35 | 21 | |
| 11 | 1 | 21 | | 50 | 36 | 3 | |
| 12 | 1 | 25 | | 51 | 37 | 1 | |
| 13 | 2 | 2 | | 52 | 37 | 4 | |
| 14 | 2 | 7 | | 53 | 38 | 30 | |
| 15 | 2 | 15 | | 54 | 40 | 2 | |
| 16 | 2 | 20 | | 55 | 42 | 8 | |
| 17 | 3 | 1 | | 56 | 1 | 1 | b |
| 18 | 3 | 2 | | 57 | 1 | 4 | a |
| 19 | 3 | 8 | | 58 | 1 | 8 | c |
| 20 | 4 | 16 | | 59 | 1 | 8 | a |
| 21 | 4 | 22 | | 60 | 1 | 9 | b |
| 22 | 5 | 1 | | 61 | 2 | 13 | a |
| 23 | 5 | 7 | | 62 | 2 | 19 | c |
| 24 | 5 | 11 | | 63 | 11 | 1 | b |
| 25 | 5 | 27 | | 64 | 17 | 9 | d |
| 26 | 7 | 1 | | 65 | 20 | 24 | a |
| 27 | 7 | 2 | | 66 | 23 | 4 | e |
| 28 | 8 | 9 | | 67 | 26 | 28 | c |
| 29 | 8 | 12 | | 68 | 33 | 8 | b |
| 30 | 16 | 2 | | 69 | 36 | 3 | a |
| 31 | 16 | 7 | | 70 | 39 | 2 | c |
| 32 | 17 | 10 | | 71 | 41 | 1 | e |
| 33 | 18 | 13 | | 72 | 41 | 4 | b |
| 34 | 21 | 1 | | 73 | 42 | 28 | a |
| 35 | 21 | 4 | | 74 | 43 | 8 | |
| 36 | 21 | 7 | | 75 | 43 | 9 | |
| 37 | 21 | 18 | | 76 | 43 | 4 | a |
| 38 | 26 | 2 | | 77 | 44 | 8 | |
| 39 | 26 | 7 | | 78 | 44 | 9 | |
| | | | | 79 | 44 | 4 | a |

Synthesis Example 1 (Synthesis of exemplified compound 8)

Reaction scheme:

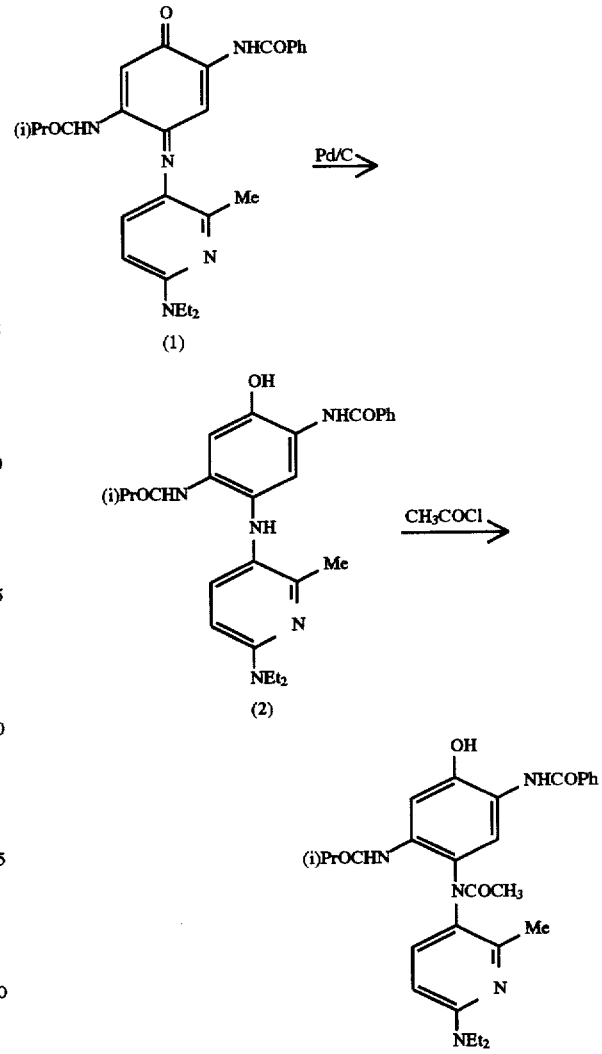

Exemplified compound 8

3.9 g of (1) was dissolved in 50 ml of ethyl acetate, 0.5 g of 5% Pd/C was added thereto and catalytic hydrogenation was carried out at ordinary pressure. Blue color of the reaction mixture disappeared and (2) was produced.

Then, to the reaction mixture were added 1.2 g of triethylamine and 1.5 g of acetylchloride, and stirring was continued for 2 hrs. at room temperature. Catalyst and insoluble material were filtered out and the residue was dissolved in ethyl acetate and recrystallized to obtain exemplified compound 8 of 3.8 g (yield, 89%). The structure was confirmed by NMR spectrum and Mass spectrum.

Synthesis Example 2 (Synthesis of exemplified compound 9)

Reaction scheme:

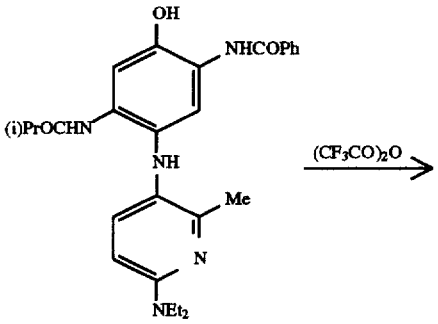

(2)

-continued

Reaction scheme:

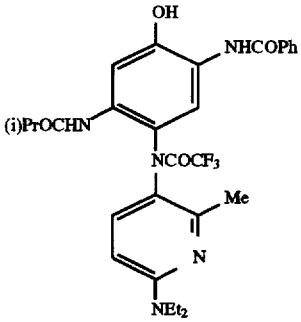

Exemplified compound 9

3.9 g of (1) of Example 1 was dissolved in 50 ml of ethyl acetate, 0.5 g of 5% Pd/C was added thereto and catalytic hydrogenation was carried out at ordinary pressure. Blue color of the reaction mixture disappeared and (2) was produced.

Then, to the reaction mixture were added 1.2 g of triethylamine and 4.0 g of trifluoroacetic acid anhydride, and stirring was continued for 2 hrs. at room temperature. Catalyst and insoluble material were filtered out and the residue was dissolved in ethyl acetate and recrystallized to obtain exemplified compound 9 of 4.0 g (yield, 85%). The structure was confirmed by NMR spectrum and Mass spectrum.

Synthesis Example 3 (Synthesis of exemplified compound 58)

Reaction scheme:

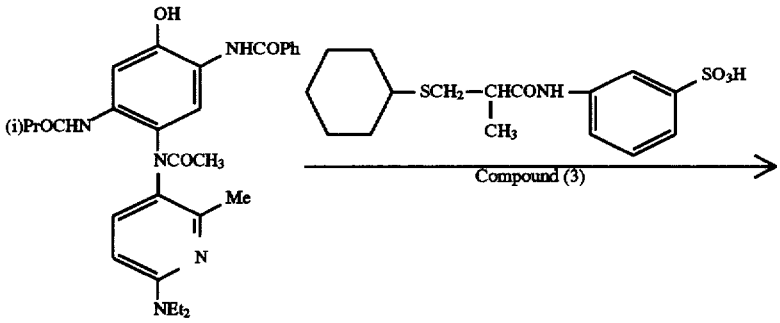

Exemplified compound 8

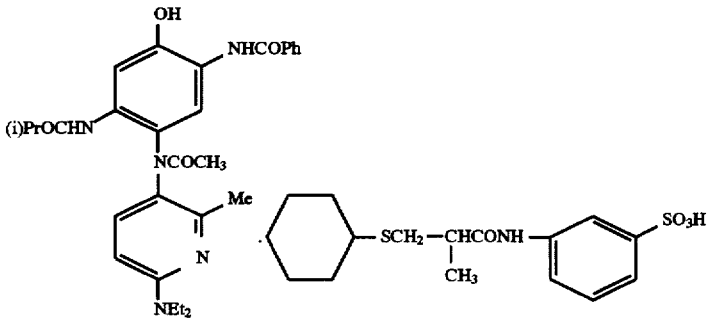

Exemplified compound 58

3.5 g of exemplified compound 8 was dissolved in 30 ml of methanol, 4.6 g of Compound (3) was added thereto and stirring was further continued.

Then, the reaction mixture was poured into water of 300 ml and filtered out to obtain exemplified compound 58 of 4.1 g (yield, 87%). The structure was confirmed by NMR spectrum and Mass spectrum.

Compound other than the above were also be readily synthesized in a manner similar to the above synthesis examples.

The addition amount of the compound represented by formula (1) through (4), particularly in the case of medical photographic materials, is preferably not less than $1\times10^{-6}$ mol per mol of silver and less than $5\times10^{-1}$ mol per mol of total silver contained in the photographic component layers provided on one side of the support. In cases of being less than the lower limit, improvement of silver image tone is small and in cases of being not less than the upper limit, overall images appear to be unpreferably dark. The addition amount is more preferably not less than $5\times10^{-5}$ mol per mol of silver and less than $5\times10^{-2}$ and furthermore preferably, not less than $5\times10^{-4}$ mol per mol of silver and less than $1\times10^{-2}$ mol per mol of silver.

The compound represented by formula (1) through (4) can added in an optional manner, depending on propertied of the compound. For example, a method in which the compound is added in the form of a dispersion of solid fine particles, a method in which the compound is dissolved in a high boiling solvent and then dispersed in a manner similar to the above and a method in which the compound is dissolved in a water-miscible organic solvent (e.g., methanol, ethanol, acetone, etc.) and then added, are cited. Among these, addition in the form of a solid fine particle dispersion or through solution in the water-miscible organic solvent is preferred. In the case of being added in the form of a solid fine particle dispersion, conventional dispersing methods, such as acid precipitation method, ball mill, jet mill and impeller dispersion can be applied. The average size of dye fine particles may be optional, preferably 0.01 to 20 μm, and more preferably, 0.03 to 2 μm.

The molar ration of the compound represented by $RSO_3H$ to the compound represented by formula (3) or (4) is preferably 1 to 3.

The compound represented by formulas (1) through (4) of the invention may be incorporated in any of photographic component layers. In the case of X-ray photographic use, the compound is preferably incorporated in an emulsion layer or a layer between a support and the emulsion layer and more preferably, in a cross-over shielding layer.

Silver halide grains usable in the invention are preferably tabular grains. With regard to halide composition, silver halide grains may optionally be any of silver bromide, silver iodobromide, silver iodochloride, silver chlorobromide, silver iodochlobromide and silver chloride. When a silver iodide content is more than 1 mol %, variations in sensitivity after storage are markedly large, so that, in cases where tabular silver halide grains contain silver iodide, the silver iodide content is not less than 1.0 mol %, preferably, 0.01 to 1.0 mol %. In this case, silver iodobromide, silver iodochlorobromide and silver chloride are preferred.

The tabular silver halide grains used in the invention may have homogeneous composition. The tabular grains with a core/shell type structure having two or more layers different in halide composition within the grain, preferably account for 50 to 100% by number of grains contained in the emulsion layer. The core/shell type structure grains may contain, in the central portion thereof, a silver halide phase different in halide composition from the core. In this case, the halide composition of seed crystal grains may be any of silver bromide, silver iodobromide, silver iodochlorobromide, silver chlorobromide and silver chloride, or a combination thereof.

The tabular silver halide grains used in the invention account for 50% or more of the total grain projected area of the photographic material, having a ratio of grain diameter to thickness (aspect ratio), i.e., an aspect ratio of 2 to 20, preferably 2 to 12 and more preferably, 3 to 8.

Effects of the present invention are markedly displayed when the tabular silver halide grains have (100) faces and an average silver chloride content of 20 to 100 mol %. The tabular silver halide grains may be polydispersed or monodispersed, and preferably monodispersed. Concretely, a distribution width defined in terms of a relative standard deviation (coefficient of variation) of grain size, as below, is preferably 25% or less, more preferably, 20% or more and furthermore preferably, 15% or less.

(standard deviation of grain size/average grain size)×100=distribution width of grain size (%)

The tabular silver halide grains used in the invention preferably have a narrow grain thickness distribution. Concretely, a distribution width of grain thickness, as defined below, is preferably 25% or less, more preferably, 20% or more and furthermore preferably, 15% or less.

(standard deviation of grain thickness/average thickness)×100=distribution width of grain thickness (%)

Furthermore, distribution of the halide content among the tabular silver halide grains used in the invention is preferably small. Concretely, a distribution width, defined as below, is preferably 25% or less, more preferably, 20% or more and furthermore preferably, 15% or less.

(standard deviation of halide content/average halide content)×100=distribution width of grain size (%)

In cases where tabular silver halide grains having twin plane(s) are used in the invention, the form of major faces is preferably hexagonal. Hexagonal tabular grains are referred to as those having hexagonal major faces ((100) face) with a maximum adjacent edge ratio of 1.0 to 2.0. The term, "maximum adjacent edge ratio is referred to as a ratio of a maximum edge length constituting the hexagon to a minimum edge. In the invention, when the maximum adjacent edge ratio is 1.0 to 2.0, the corner of the tabular grains preferably is roundish. In the case where the corner is roundish, a length of an edge is expressed as a distance between crossing points of a extended straight line of the edge with extended straight lines of adjacent edges. Substantially circular, tabular grains are also preferred.

In the invention, ½ or more of each edge constituting the hexagon of the hexagonal tabular grains is preferably in the form of a straight line. In the invention, the maximum adjacent edge ratio is more preferably 1.0 to 1.5.

Silver halide grains relating to the invention may have a dislocation. With regard to the number of the dislocation, 50% or more by number of the grains preferably have at least one dislocation. The more is the proportion of tabular grains having the dislocation, the more preferable.

In the invention, the grain diameter is a diameter of a circle equivalent to the projected area of the grain and the total projected area can be obtained from the sum of grain projected area. These can be determined through electron-microscopic observation of a sample of silver halide grains distributed so as not to overlap one another on a sample stand.

An average projected area diameter of the tabular silver halide grains used in the invention is expressed in terms of circular equivalent diameter of the grain and preferably 0.30 μm or more, more preferably, 0.30 to 5 μm and furthermore preferably, 0.40 to 2 μm.

The diameter can be determined by magnifying the grains 10,000 to 70,000 times by an electronmicroscope and measuring the projected area of the print.

An average grain diameter (ϕi), when the number of measured grain diameter is designated as n and the frequency of the grain having a diameters di is designated as ni, can be determined based on the following equation.

$$\text{Average grain diameter } (\phi i) = ni \cdot di / n$$

(The number of measured grains shall be not less than 1000 at random)

The grain thickness is the distance between two parallel major faces that form a tabular grain, and can be determined by observing aslant the grain through an electronmicroscope. The thickness of the tabular grains used in the invention is preferably 0.03 to 1.0 μm, and more preferably 0.05 to 0.5 μm.

In cases where silver halide grains have two or more parallel twin planes, a ratio of grain thickness (b) to a maximum (a) of spacing(s) between the two or more parallel twin planes (b/a) is preferably 5 or more; and its proportion is preferably 50% or more by number of the grains.

In the invention, an average value of (a) is preferably 0.08 μm or more, and more preferably 0.010 to 0.05 μm. A variation coefficient of (a) is also 35% or less, and preferably 30% or less.

Further, taking into account of the aspect ratio and grain thickness, tabularity (A), defined as below, is preferably 20 or more.

$$A = ECD/b^2$$

wherein ECD is an average projection diameter of tabular grains and b is a grain thickness. The average projection diameter is a number-averaged value of a diameter of a circle equivalent to the projected area of the tabular grain.

The tabular silver halide grains used in the invention may have homogeneous composition. The tabular grains with a core/shell type structure having two or more layers different in halide composition within the grain, preferably account for 50 to 100% by number of grains contained in the emulsion layer. The core/shell type structure grains may contain, in the central portion thereof, a silver halide phase different in halide composition from the core. In this case, the halide composition of seed crystal grains may be any of silver bromide, silver iodobromide, silver iodochlorobromide, silver chlorobromide and silver chloride, or a combination thereof.

In the preparation of the emulsion relating to the invention, silver halide solvents known in the art, such as ammonium, thioether, thiourea, etc., may be present at the time of forming and growing seed grains.

As the growing condition for the seed grains prepared for obtaining the tabular silver halide grains, there may be used a method in which an aqueous silver salt solution and an aqueous halide solution are added according to a double jet precipitation process at a flowing rate being gradually accelerated within limits not allowing any new nucleation and Ostwald ripening to occur as the grains grow, as disclosed in JP-A 51-39027, 55-142329, 58-113928, 54-48521 and 58-49938. As another growing condition of the seed grains, there may also be used a method in which silver halide fine grains are added, as disclosed in Item 88 of Abstract of papers presented to the a Annual Conference '83 of the Society of Photographic Science and Technology of Japan. In the process of grain growth, an aqueous silver nitrate solution and aqueous halide solution can be added according to the double jet precipitation method and at least a part of the halide may be supplied in the form of fine silver halide grains. The addition is preferably made at a flowing rate not allowing any nucleation and any grain size distribution broadening due to Ostwald ripening to occur; i.e., at the rate in the range of 30 to 100% of a new nucleus forming speed. In the preparation of the silver halide emulsion, the stirring condition in its manufacturing process is very important. The most preferred stirring device is one having therein a solution-adding nozzle, provided immersedly in liquid in the proximity of the mother liquor inlet hole, as disclosed in JP-A 62-160128, in which the number of revolutions of the stirrer is preferably 400 to 1200 rpm.

The iodide content and the average iodide content of the silver halide grains can be determined according to EPMA (Electron Probe Micro-Analyzer) method. Further, the silver halide grains may contain, in the inside and/or surface phase of the grain, metallic ions of at least one of salts selected from among cadmium salts, zinc salts, thallium salts, iridium salts (including complex salts thereof), rhodium salts (including complex salts thereof), and iron salts (including complex salts thereof). The silver halide grains can contain internally and/or in the surface portion, a reduction. sensitization center by being placed in optimal reductive atmosphere.

An oxidizing agent, such as hydrogen peroxide, thiosulfonic acids, may be added at a time during the grain formation. The silver halide emulsion relating to the invention may have its useless water-soluble salts removed therefrom after completion of grain growth, or remain unremoved. Removal of the salts can be carried out, based on the method described in Research Disclosure (hereinafter, denoted as RD) No. 17643, Section II.

In the silver halide photographic light sensitive material relating to the invention, selenium and/or tellurium sensitizers can be used as a chemical sensitizer. The selenium sensitizer includes a variety of selenium compounds. Thus, the selenium sensitizer includes colloidal selenium element, isoselenocyanates (e.g., allylisoselenocyanate, etc.); selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea, etc.); selenoketones (e.g., selenoacetone, selenoacetophenone, etc.); selenoamides) e.g., selenoacetoamide, N,N-dimethylselenobenzamide, etc.); selenocarbonic acids and selenoesters (e.g., 2-selenopropionic acid, methyl-3-selenobutylate, etc.); selenophosphates (e.g., tri-p-triselenophosphate, etc.); and selenides (e.g., triphenylphosphineselenide, diethyldiselenide, etc.). Specifically, preferred selenium sensitizers are selenides, selenoureas, selenoamides and selenoketones.

The addition amount of the selenium sensitizer is varied, depending on the selenium compound, silver halide grains or chemical ripening conditions and, in general, $1\times10^{-8}$ to $1\times10^{-4}$ mol per mol of silver halide. The incorporation of the selenium sensitizer into the emulsion may be carried out by any one of optimal methods according to properties of the selenium sensitizer used, such as by adding in the form of a solution of it dissolved in water or in an organic solvent such as ethanol or a mixture thereof; by adding in the form of a previously prepared mixture of it with n aqueous gelatin solution; or by adding in the form of an emulsified dispersion of it with an organic solvent-soluble polymer, as disclosed in JP-A 4-140739.

The chemical-ripening temperature with the use of the selenium sensitizer is preferably 40° to 90° C., and more preferably 45° to 80° C. The pH and pAg are preferably 4 to 9 and 6 to 9.5, respectively.

The tellurium sensitizer used in the chemical sensitization includes telluroureas (e.g., N,N-dimethyltellurourea, tetramethyltellurourea, N-carboxyethyl-N,N'-dimethyltellurourea, N,N'-dimethyl-N'-phenyltellurourea, etc.); phosphinetellurides (e.g., tributylphosphinetelluride, tricyclohexylphosphine-telluride, triisopropylphosphinetelluride, butyldiisopropylphosphinetelluride, dibutylphenylphosphinetelluride, etc.); telluroamides (e.g., telluroacetoamide, N,N-dimethyltellurobenzacetoamide, etc.); telluroketones, telluroesters; and isotellurocyanates. Techniques for using these tellurium sensitizers follow those for the foregoing selenium sensitizers.

In the invention, it is preferred to use a reduction sensitizer in combination. The reduction sensitizer is preferably added in the course of growing silver halide grains. The method of adding the reduction sensitize during the grain growth includes not only a method of adding the sensitizer while the grain growth is going on but also a method of adding it while the growth is suspended and then resuming the growth of the reduction-sensitized silver halide grains.

In the invention, the silver halide emulsion may be sensitized with a selenium compound and a tellurium compound, and can also be sensitized further with a sulfur compound and a novel metallic salt such as a gold salt. The reduction sensitization may be carried out by using these sensitizing methods in combination.

Preferred examples of the sulfur sensitizer include thiourea derivatives, such as 1,3-diphenyl-thiourea, triethylthiourea, 1-ethyl-3-(2-thiazolyl)thiourea; rhodanine derivatives; dithiacarbamic acids, polysulfide organic compounds; sulfur single body. The sulfur single body is preferably rhombic α-sulfur. The gold sensitizer includes chloroauric acid, gold thiosulfate, gold thiocyanate, and complex salts of gold with thioureas, rhodanines and other various compounds.

The using amount of the sulfur sensitizer or gold sensitizer, although depending on the type of the silver halide emulsion used, the kind of the compound used, the ripening conditions applied, etc., is preferably $1\times10^{-4}$ to $1\times10^{-9}$, and more preferably $1\times10^{-5}$ to $1\times10^{-8}$ mol per mol of silver halide.

The sulfur sensitizer and gold sensitizer can be incorporated, in the form of a solution, through dissolution in water, an alcohol, or organic or inorganic solvent; or, in the form of a emulsified dispersion, through dispersion by the use of a water-insoluble solvent or a dispersing medium such as gelatin.

The sulfur sensitization and gold sensitization may be conducted either simultaneously or separately stepwise. In the latter case, preferred results can be obtained when the gold sensitization is conducted after nearly completion of or in the midst of the sulfur sensitization.

The reduction sensitization is conducted by adding a reducing agent and/or a water-soluble silver salt during the growth of the silver halide grains of the silver halide emulsion. Preferred examples of the reducing agent include thiourea dioxide, ascorbic acid and derivatives thereof. Other preferred examples of the reducing agent include polyamines such as hydrazine, diethylenetriamine, dimethylamine boranes and sulfites.

The adding amount of the reducing agent is preferably varied, depending on the type of the reducing agent used, size, composition and crystal habit of the silver halide grains, and ambient conditions such as the temperature, pH and pAg of the reaction system; for example, in the case of thiourea oxide, when used in an amount of ca. 0.01 to 2 mg per mol of silver halide, satisfactory results can be obtained, while in ascorbic acid, its preferred amount is ca. 50 mg to 2 g per mol of silver halide.

The reduction sensitization is conducted preferably for 10 to 200 min. at a temperature of 40° to 70° C., pH of 5 to 11, and pAg of 1 to 10 (the pAg value is logarithmic reciprocal of Ag+ ion concentration).

The silver halide photographic light sensitive material of the invention comprises preferably a light-sensitive silver halide emulsion layer and a substantially light-insensitive hydrophilic colloidal layer. The substantially light-insensitive hydrophilic colloidal layer is a hydrophilic colloidal layer which does not contribute directly to formation of a silver image; i.e., photographic component layer(s) other than the light-sensitive silver halide emulsion layer including, for example, a protective layer, interlayer, subbing layer, dye layer and cross-over light shielding layer.

The silver halide photographic light sensitive material contains a hydrophilic binder in an amount of 1.3 to 2.7 g, and preferably 1.5 to 2.4 g per $m^2$ of one side. The hydrophilic binder is preferably gelatin.

The silver halide photographic light sensitive material is preferably processed within a total processing time of 10 to 30 sec. The total processing time is a period from the time when the top of the photographic material immersed into a developer, via processing steps, to the time when the top comes out from a drying zone so-called, Dry to dry time). It is 10 to 30 sec., and preferably 25 or less.

The silver halide photographic light sensitive material is processed by an automatic processor at a replenishing rate of a developer of 30 to 200 ml, and preferably 50 to 150 ml per $m^2$ of the photographic material.

The silver halide photographic light sensitive material contains a spectral-sensitizing dye having, within its molecule, two benzimidazole nuclei and a trimethine group. The dye is contained preferably in combination with another dye, and, more preferably, the two benzimidazole nuclei each contain a sulfonyl group, furthermore preferably, a electron-withdrawing group.

The spectrally sensitizing dye used in the silver halide photographic light sensitive material of the invention achieves enhanced effects by incorporating in the form of fine solid particle dispersion rather than in the form of a solution of an organic solvent. Specifically, the spectrally sensitizing dye is incorporated in the form of sparingly water-soluble, fine solid particles dispersed in an aqueous medium substantially free from an organic solvent or surfactant. In cases where the is incorporated in the form of a solid fine particle dispersion, the solubility in water of the dye is preferably $2\times10^{-4}$ to $4\times10^{-2}$ mol/l, and more preferably $1\times10^{-3}$ to $4\times10^{-2}$ mol/l.

In the invention, fine silver halide grains may be added during the course of chemical ripening to coating. The course of chemical ripening to coating includes a period of the chemical ripening; and the fine silver halide grains may be added in the subsequent process before coating. Fine silver iodide grains, for example, are added preferably in the step of chemical ripening. The addition is preferably conducted under such a condition that a part or all (preferably, 20% or more) of the fine silver iodide grains disappear immediately before coating.

In cases where the silver halide photographic light sensitive material is applied to the use for X-ray photography, a cross-over light shielding layer is provided preferably between a silver halide emulsion layer and a support, and more preferably between the emulsion layer and the first sub layer provided on the support. The coating amount of the hydrophilic colloid of the cross-over light shielding layer is not less than 0.05 g/m$^2$ and less than 0.5 g/m$^2$, and preferably not less than 0.18 g/m$^2$ and less than 0.42 g/m$^2$. Preferred dyes contained in the cross-over light shielding layer are a solid fine particle dispersion of dyes described in Japanese Patent Application No. 7-265697, on pages 67–69, and as exemplary examples thereof are cited (AD-2), (AD-3), (AD-4), (AD-7) and (AD-10).

The method of dispersing the dye is not limitative and a variety of known methods, such as acid precipitation process, or ball mill, jet mill and impeller dispersing methods may be applied. The average size of the fine dye particles dispersed in the form of a solid particle dispersion may take any value, preferably 0.01 to 20 μm, and more preferably 0.03 to 2 μm. A variation coefficient of particle size is preferably 60% or less, and more preferably 40% or less.

For the silver halide photographic light sensitive material relating to the invention, there may be used a variety of photographic additives. Well-known photographic additives include the compounds described in Research disclosure No. 17643 (December, 1978), No. 18716 (November, 1979) and No. 308119 (December , 1989), wherein the relevant types of compounds and their sections are as follows.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IVA |
| Desensitizing dye | 23 | IV | | 998 | IVB |
| Dye | 25–26 | VIII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Antistatic agent | 27 | XII | 650 right | 1006–7 | XIII |
| Plasticizer | 27 | XII | 650 right | 1006 | XII |
| Slipping agent | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

As supports used in the photographic material of the invention are cited those described in afore-mentioned RD-17643 at page 28 and RD-308119 at page 1009. As an optimal support is cited polyethylene terephthalate film. The surface of the support may be sub-coated or exposed to corona discharge or UV-ray.

The silver halide photographic light sensitive material of the invention can be processed with processing solutions, as described in the afore-described RD-17643, XX-XXI, pages 29–30 and RD-308119, XX-XXI, pages 1011–1012.

As a developing agent are usable dihydroxybenzenes (e.g., hydroquinone), 3-pyrazolidones (e.g., 1-phenyl-3-pyrazolidone), aminophenols (e.g., N-methyl-p-aminophenol), each or a combination thereof. A developer may optionally contain a preservative, alkali agent, pH buffer, antifoggant, hardener, development accelerator, surfactant, defoamer, color toning agent, water-softener, dissolving aid or thickener.

In a fixer is used a fixing agent, such as a thiosulfate and thiocyanate. The fixer may contain, as a hardener, a water-soluble aluminium salt, as a hardener, such as aluminium sulfate or potassium alum; and a preservative, pH-adjusting agent or water-softener.

EXAMPLES

Examples of the present invention will be described in detail as below, but the invention is not limited thereto.

In the following examples, comparative compounds 1 and 2, and compounds represented by formula (1), 8, 9, 18, 27, 30, 38, 42, 57, 58, 60 and 65 are each added in the form of a solid particle dispersion, according to the method described in Japanese Patent application No. 6-221890 at page 40.

Compounds represented by formula (1), 19 and 51 were each added in the form a methanol solution.

Comparative compound 3, and compounds represented by formula (1), 70, 76 and 77 were each dissolved in ethyl acetate and an optimal amount of tricresyl phosphate and dispersed according to the method described in Example 1 of JP-A 5-165147.

Example 1

Preparation of emulsion Em-1:

Silver iodobromide tabular grain emulsion was prepared in the following manner.

Preparation of emulsion Em-1' (seed emulsion)

| | | |
|---|---|---|
| A1 | Ossein gelatin | 24.2 g |
| | Water | 9657 ml |
| | $HO—(CH_2CH_2O)_n—[CH(CH_3)CH_2O]_{17}(CH_2CH_2O)_mH$ (n + m = 5 – 7) (10% ethanol aq. solution) | 1.20 ml |
| | Potassium bromide | 10.8 g |
| | 10% nitric acid solution | 160 ml |
| B1 | Aqueous 2.5N silver nitrate solution | 2825 ml |
| C1 | Potassium bromide | 841 g |
| | Add water to make | 2825 ml |
| D1 | Ossein gelatin | 121 g |
| | Water | 2040 ml |
| | $HO—(CH_2CH_2O)_n—[CH(CH_3)CH_2O]_{17}(CH_2CH_2O)_mH$ (n + m = 5 – 7) (10% ethanol aq. solution) | 5.70 ml |
| E1 | An aqueous 1.75N potassium bromide solution An amount for controlling the following silver potential | |

To Solution A1, Solutions B1 and C1 were each added in an amount of 475.0 ml at 35° C. by making use of a mixing stirrer shown in examined and published Japanese Patent 58-58288 and 58-58289 in a double-jet process by taking 2.0 minutes, so that nucleus grains were formed.

After stopping the addition of Solutions B1 and C1, the temperature of Solution A1 was raised to 60° C. by taking 60 minutes and the pH thereof was adjusted to be 5.5 by making use of a 3% KOH solution. Thereafter, Solutions B1 and C1 were each added thereto again at a flow rate of 55.4 ml/min. for 42 minutes in the double-jet process. At the time for raising the temperature from 35° C. to 60° C. and the time for the subsequent double-jet process carried out with Solutions B1 and C1, the silver potential (measured by a silver-ion selection electrode together with a saturated silver-silver chloride electrode as a control electrode) was so controlled as to be +8 mV and +30 mV by making use of Solution E1, respectively.

After the completion of the addition, the pH was adjusted to be 6 with a 3% KOH solution and a desalting treatment were immediately carried out. The resulting seed emulsion was proved through an electron microscope as follows. Not less than 90% of the whole projected area of the silver halide grains thereof were comprised of hexagonal, tabular-shaped grains having the maximum adjacent edge ratio within the range of 1.0 to 2.0; and the average thickness and average grain-size (converted into the diameter of the corresponding circle, i.e., circle equivalent diameter) of the hexagonal tabular grains were proved to be 0.090 μm and 0.510 μm, respectively.

Next, the resulting emulsion (Em-1') was raised to be 53° C. and a given amount of a spectral sensitization dyes A and B were added thereto in the form of a solid fine particle dispersion prepared as below. After adding it, an aqueous mixture solution of 4-hydroxy-6-methyl-1,3,3a,7-tetrazaindene (TAI), adenine, ammonium thiocyanate, chloroauric acid and sodium thiosulfate; a silver iodide fine grain emulsion and a dispersion of triphenyl phosphine selenide were added. Then, a chemical-ripening was carried out for two and half hours in total. At the time of completing the ripening, a given amount of 4-hydroxy-6-methyl-1,3,3a,7-tetrazaindene (TAI) was added as a stabilizer and an emulsion Em-1 was obtained.

The above-mentioned spectral sensitizing dyes, additives and the addition amount thereof (per mol of AgX) are shown below.

| | |
|---|---|
| Sensitizing dye (A) | |
| Anhydride of sodium 5,5'-dichloro-9-ethyl-3,3'-(3-sulfopropyl)-oxacarbocyanine | 450 mg |
| Sensitizing dye (B) | |
| An anhydride of sodium 5,5'-di-(butoxycarbonyl)-1,1'-diethyl-3,3'-di-(4-sulfobutyl)-benzoimidazolocarbocyanine | 8.0 mg |
| 4-Hydroxy-6-methyl-1,3,3a,7-tetrazaindene (TAI) | 60 mg |
| Adenine | 15 mg |
| Sodium thiosulfate | 5.0 mg |
| Ammonium thiocyanate | 50 mg |
| Chloroauric acid | 2.5 mg |
| Silver iodide emulsion (av. grain size 0.05 μm) | 5 mmol |
| Triphenylphosphine selenide | 6.0 mg |
| 4-Hydroxy-6-methyl-1,3,3a,7-tetrazaindene (TAI) | 750 mg |

The solid, fine-grain, dispersion of the spectral sensitization dyes were each prepared in the process according to the process described in Japanese Patent Application No. 4-99437. To be more concrete, they were prepared in such a manner that a given amount of the spectral sensitization dye was added to water thermally controlled to be 27° C. and it was stirred at 3,500 rpm by making use of a high-speed dissolver for a period within the range of 30 to 120 minutes.

The dispersion of the above-mentioned selenium sensitizer was prepared in the following manner. Thus, 120 g of triphenylphosphine selenide was added to 30 kg of ethyl acetate kept at 50° C. and then so stirred as to be dissolved completely. On the other hand, 3.8 kg of photographic gelatin was dissolved in 38 kg of water and, thereto, an aqueous 25 wt % of sodium dodecylbenzene sulfonate was added. Next, these two solutions were mixed up and the resulting mixture was dispersed at 50° C. for 30 minutes by making use of a high-speed stirring disperser provided with a 10-cm dissolver at a dispersion blade speed of 40 m/sec. Thereafter, the remaining ethyl acetate was removed while a stirring was rapidly carried out under reduced pressure so that the ethyl acetate concentration could be not higher than 0.3 wt %. Then, the resulting dispersion was diluted by making use of pure water so as to make 80 kg. A part of the resulting dispersion was fractionally extracted so as to use for the above-mentioned experiment.

Preparation of emulsion, Em-2:

By making use of Seed emulsion-1' and the following 4 kinds of solutions, silver halide tabular grain emulsion Em-2 was prepared.

| | | |
|---|---|---|
| A2 | Ossein gelatin | 19.04 g |
| | $HO—(CH_2CH_2O)_n—[CH(CH_3)CH_2O]_{17}(CH_2CH_2O)_mH$ (n + m = 5 − 7) (10% ethanol aq. solution) | 2.00 ml |
| | Potassium iodide | 7.00 g |
| | Em-1' (Seed emulsion) | 1.55 mol. eq. |
| | Water to make | 2800 ml |
| B2 | Potassium bromide | 1493 g |
| | Water to make | 3585 ml |
| C2 | Silver nitrate | 2131 g |
| | Water to make | 3585 ml |
| D2 | A fine-grained emulsion* comprising 3 wt % of gelatin and silver iodide grains (having an average grain-size of 0.05μ) Equivalent to 0.028 mols | |

To 6.64 liters of an aqueous 5.0 wt % gelatin solution containing 0.06 mols of potassium iodide, 2 liters each of an aqueous solution containing 7.06 mols of silver nitrate and an aqueous solution containing 7.06 mols of potassium iodide were added by taking 10 minutes. In the course of forming the fine grains, the pH was controlled to be 2.0 by making use of silver nitrate, and the temperature was controlled to be 40° C. After completing the grain formation, the pH was adjusted to be 6.0 by making use of an aqueous sodium carbonate solution.

In a reaction vessel, Solution A2 was vigorously stirred with keeping the temperature at 55° C. and thereto, a half of Solution B2 and a half of Solution C2 were added in a double-jet method by taking 35 minutes, while being kept at a pH of 5.8. After the pH was adjusted to 8.8 with a 1% KOH aqueous solution, a part of Solutions B2 and C2 and all of Solution D were added in triple-jet method. After the pH was adjusted to 6.0 with 0.5% citric acid aqueous solution, remaining Solutions B2 and C2 were added in double-jet method by taking 25 minutes. In the above-mentioned courses, the pAg thereof were kept at 8.9 for all the while. During addition, the flow rates of Solutions B2 and C2 were acceleratedly varied so as to meet the critical growth rate. Thus, mixing was carried out at an appropriate flow rate so as not to produce any nucleus grain other than growing seed grains and cause Ostwald ripening to have the grains polydispersed.

After completing addition, the emulsion was desalted and then redispersed in a manner similar to Em-1. After redispersing, the pH and pAg each were adjusted to 5.80 and 8.2 at 40° C.

According to electron microscopic observation, it was proved to be the tabular-shaped silver halide grains having the average grain-size of 0.91μ, the average thickness of 0.23μ, the average aspect ratio of about 4.0 and the grain-size distribution width of 20.5%.

Next, the resulting emulsion) was raised to be 47° C. and a silver iodide emulsion, spectral sensitization dyes A and B were added thereto in the form of a solid fine-grain dispersion. After adding it, an aqueous mixture solution of adenine, compound (R), ammonium thiocyanate, chloroauric acid and sodium thiosulfate and a dispersion of triphenyl phosphine selenide were added and then, a chemical-ripening was carried out for two and half hours in total. At the time of completing the ripening, a given amount of 4-hydroxy-6-methyl-1,3,3a,7-tetrazaindene (TAI) was added as a stabilizer and an emulsion (Em-2) was obtained.

The above-mentioned additives and the amount of them added (per mol of AgX) are shown below.

| | |
|---|---|
| Sensitizing dye (A) | |
| Anhydride of sodium 5,5'-dichloro-9-ethyl-3,3'-(3-sulfopropyl)-oxacarbocyanine | 390 mg |
| Sensitizing dye (B) | |
| An anhydride of sodium 5,5'-di-(butoxycarbonyl)-1,1'-diethyl-3,3'-di-(4-sulfobutyl)-benzoimidazolocarbo-cyanine | 4 mg |
| Adenine | 10 mg |
| Compound (R) | 20 mg |
| Sodium thiosulfate | 3.3 mg |
| Ammonium thiocyanate | 50 mg |
| Chloroauric acid | 2.0 mg |
| Silver iodide emulsion | 5 mmol silver equivalent |
| Triphenylphosphine selenide | 4.0 mg |
| 4-Hydroxy-6-methyl-1,3,3a,7-tetrazaindene (TAI) | 750 mg |

In the above, the silver iodide emulsion is an emulsion comprised of 3% by weight of gelatin and silver iodide fine grains (average grain size of 0.05 μm).

Next, the above chemically sensitized emulsions Em-1 and Em-2 were blended in a ratio of 60:40 by weight and additives as shown below were added thereto to prepare a coating solution of an emulsion layer. Further, coating solutions of a cross-over light shielding layer and a protective layer were each prepared.

Preparation of crossover-light shielding layer

Blue-tinted polyethylene terephthalate film for X-ray use (having a thickness of 175 μm) which was coated with a sublayer comprising copolymer of glycidyl methaacrylate of 50 wt. %, methyl methacrylate of 10 wt. % and butyl methacrylate of wt. %; and a cross-linked sub layer mainly comprised of gelatin was used as a support.

On both sides of the support, the following cross-over have light shielding layer was coated and further on both sides thereof, the emulsion layer and protective layer were simultaneously coated in this order from the support so as to have the following composition and dried. Prepared samples are shown in Table 1.

The addition amount was shown in terms of a coating amount per one side of the photographic material.

| | |
|---|---|
| 1st Layer (Cross-over light shielding layer) | |
| Solid fine particle dispersion of dye (AD) | 180 mg/m$^2$ |
| Gelatin | 0.2 g/m$^2$ |
| Sodium dodecylbenzene sulfonate | 5 mg/m$^2$ |
| Compound (I) | 5 mg/m$^2$ |
| Compound (L) | 0.2 mg/m$^2$ |

-continued

| | |
|---|---|
| Sodium 2,4-dichloro-6-hydroxy-1,3,5-triazine | 5 mg/m$^2$ |
| Inventive or comparative compound as shown in Table 1 | |
| Colloidal silica (having an average particle-size of 0.014 μm) | 10 mg/m$^2$ |
| Hardener (A)) | 2 mg/m$^2$ |
| 2nd Layer (Emulsion layer) | |
| To each of emulsions obtained above, the following additives were added. | |
| Compound (G) | 0.5 mg/m$^2$ |
| 2,6-bis(hydroxyamino)-4-diethylamino-1,3,5-triazine | 5 mg/m$^2$ |
| t-Butyl-catechol | 130 mg/m$^2$ |
| Polyvinyl pyrrolidone (having a molecular weight of 10,000) | 35 mg/m$^2$ |
| A styrene-maleic acid anhydride copolymer | 80 mg/m$^2$ |
| Sodium polystyrene sulfonate | 80 mg/m$^2$ |
| Trimethylol propane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Compound (R) | 2 mg/m$^2$ |
| Colloidal silica | 0.5 mg/m$^2$ |
| Latex (L) | 0.2 mg/m$^2$ |
| Dextran (av. M.W. 1,000) | 0.2 mg/m$^2$ |
| Inventive or Comparative compound as shown in Table 2 | |
| Compound (Q) | 0.2 mg/m$^2$ |
| Gelatin was adjusted to be in an amount of 0.8 g/m$^2$. | |
| 3rd Layer (Protective layer) | |
| Gelatin | 0.6 g/m$^2$ |
| A matting agent comprising polymethyl methacrylate (having an area average particle-size of 7.0 μm) | 50 mg/m$^2$ |
| Formaldehyde | 20 mg/m$^2$ |
| Sodium 2,4-dichloro-6-hydroxy-1,3,5-triazine | 10 mg/m$^2$ |
| Bis-vinylsulfonylmethyl ether | 36 mg/m$^2$ |
| Latex (L) | 0.2 g/m$^2$ |
| Polyacrylamide (having an average molecular weight of 10000) | 0.1 g/m$^2$ |
| Sodium polyacrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}$—O—$(CH_2CH_2O)_{11}$—H | 3 mg/m$^2$ |
| $C_8F_{17}SO_2N(C_3H_7)$—$(CH_2CH_2O)_{15}$H | 2 mg/m$^2$ |
| $C_8F_{17}SO_2N(C_3H_7)$—$(CH_2CH_2O)_4$—$(CH_2)_4SO_3Na$ | 1 mg/m$^2$ |
| Compound represented by formula (1) or Comparative compound as shown in Table 2 | |
| Hardener | 2 mg/m$^2$ |

The amount of silver provided were each adjusted to be 1.5 g/m$^2$ for one side use.

Compound (G)
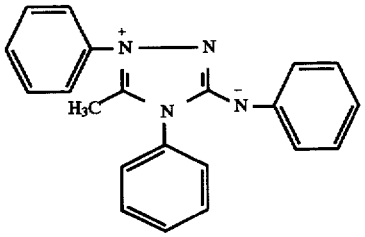
Compound (H)
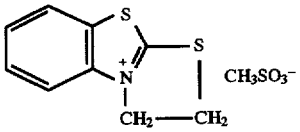
Compound (I)
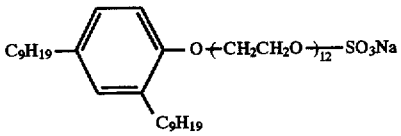
Compound (J)
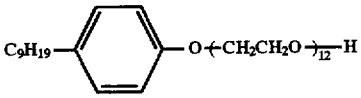
Compound (K)
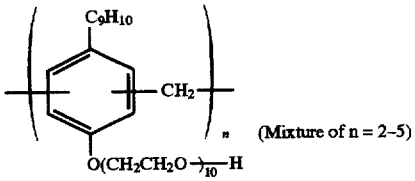
(Mixture of n = 2–5)
Compound (S-1)
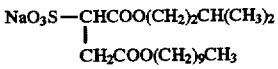
Compound (S-2)
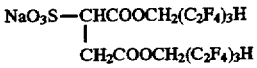
Latex (L)
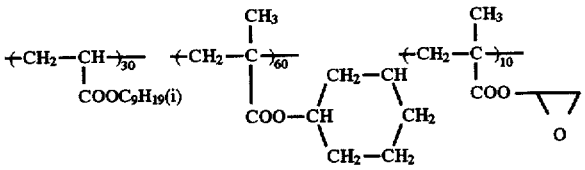
-continued
Polysiloxane (SI)
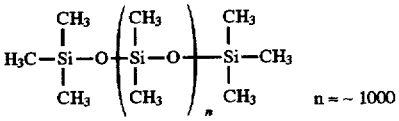
Compound (O)
$C_{11}H_{23}CONH(CH_2CH_2O)_5H$
Hardener (B)
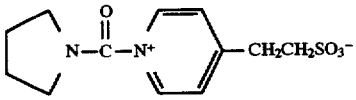
Compound (P)
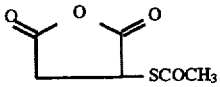
Compound (Q)
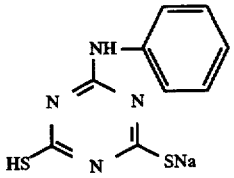
Compound (M)
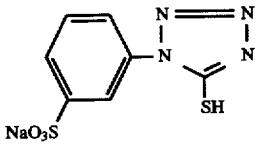
Compound (N)
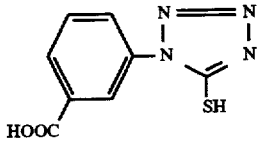
Compound (R)
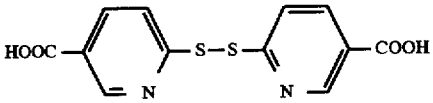
Hardener (A)
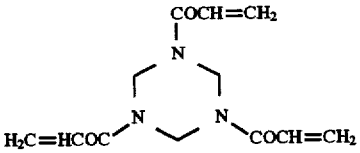

-continued

AD

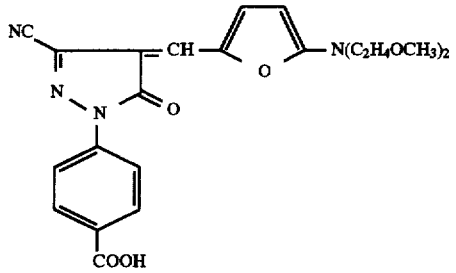

Comparative compound 1 (Comp-1), described in JPA-3-157645

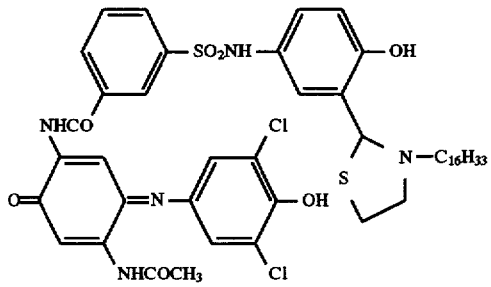

Comparative compound 2 (Comp-2), described in JPA-3-53234

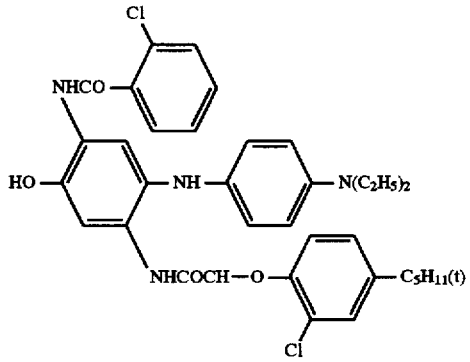

Comparative compound 3 (Comp-3), described in JPA-5-165147

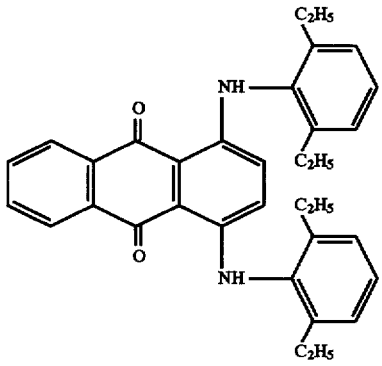

TABLE 2

| Sample No. | Light Shielding layer Compound (mol/mol Ag) | | Emulsion layer Compound (mol/mol Ag) | | Protective layer Compound (mol/mol Ag) | | Remarks |
|---|---|---|---|---|---|---|---|
| 1-1 | — | — | — | — | — | — | Comp. |
| 1-2 | Comp-1 | $2 \times 10^{-3}$ | — | — | — | — | Comp. |
| 1-3 | Comp-2 | $2 \times 10^{-3}$ | — | — | — | — | Comp. |
| 1-4 | Comp-3 | $2 \times 10^{-3}$ | — | — | — | — | Comp. |
| 1-5 | 8 | $2 \times 10^{-3}$ | — | — | — | — | Inv. |
| 1-6 | — | — | 8 | $2 \times 10^{-3}$ | — | — | Inv. |
| 1-7 | — | — | — | — | 8 | $2 \times 10^{-3}$ | Inv. |
| 1-8 | 18 | $7 \times 10^{-4}$ | 18 | $7 \times 10^{-4}$ | — | — | Inv. |
| 1-9 | 38 | $1 \times 10^{-4}$ | — | — | — | — | Inv. |
| 1-10 | 51 | $1 \times 10^{-4}$ | — | — | — | — | Inv. |
| 1-11 | 57 | $3 \times 10^{-4}$ | — | — | — | — | Inv. |
| 1-12 | 65 | $2 \times 10^{-3}$ | — | — | — | — | Inv. |
| 1-13 | — | — | 76 | $2 \times 10^{-3}$ | — | — | Inv. |
| 1-14 | — | — | 77 | $2 \times 10^{-3}$ | — | — | Inv. |

Evaluation of storage stability (sensitivity, fog), silver image tone, staining of intensifying screen and fog Sensitivity Samples each were laminated with fluorescent screens (KO-250), exposed to X-ray through a penetrometer type B (product by Konica Corp.) and processed, using an automatic processor SRX-503 (product by Konica Corp.) and processing solutions SR-DF (product by Konica Corp.) at a developing temperature of 35° C. and for 45 sec. In this case, the replenishing rate of the developer or fixer was 210 $ml/m^2$.

The sensitivity ($S_1$) was shown as a relative value of reciprocal of the X-ray exposure amount necessary for obtaining a density of a minimum density plus 1.0, based on the sensitivity of Sample 1-1 being 100. As a measure of storage stability, samples were allowed to stand for 4 hrs. at 23° C. and 48% R.H., then, packaged in moisture-resistance package and further allowed to stand for 4 days at 55° C.; thereafter, samples were exposed in the same manner as above and evaluated with respect to the sensitivity after storage ($S_2$).

Smudge of screen

Samples each were rubbed with a fluorescent screen (intensifying screen) 500 times and evaluated, by visually observing the surface thereof, with respect to smudging of the screen.

Silver image tone

Silver image tone was evaluated by visually observing image color of a portion with a density of 1.5 of the processed photographic material sample. In Table 3, Y.Bl: Yellowish black image tone R.Bl: Reddish black image tone G.Bl: Greenish black image tone N.Bl: Neutral black image tone D.B: Dark blue image tone Fog Processed samples were allowed to stand for 4 hrs. at 23° C. and 48% R.H., then packaged in moisture-resistance package and further allowed to stand for 4 days at 55° C. Densities of the aged samples were measured and difference in minimum density from Sample 1 was compared as a measure of storage stability of processed photographic materials.

Results thereof are shown in Table 3.

TABLE 3

| Sample No. | Sensitivity($S_1$)* | After storage $S_2$ | Smudge | Image tone | Fog | Remarks |
|---|---|---|---|---|---|---|
| 1-1 | 100 | 75 | not obs.** | Y · Bl | 0.000 | Comp. |
| 1-2 | 51 | 40 | obs. | R · Bl | 0.005 | Comp. |
| 1-3 | 82 | 69 | not obs. | G · Bl | 0.010 | Comp. |
| 1-4 | 67 | 55 | obs. | N · Bl | 0.009 | Comp. |
| 1-5 | 95 | 89 | not obs. | N · Bl | 0.000 | Inv. |
| 1-6 | 88 | 83 | not obs. | N · Bl | 0.000 | Inv. |
| 1-7 | 91 | 86 | not obs. | N · Bl | 0.000 | Inv. |
| 1-8 | 92 | 87 | not obs. | N · Bl | 0.001 | Inv. |
| 1-9 | 85 | 81 | not obs. | D · B | 0.002 | Inv. |
| 1-10 | 84 | 79 | not obs. | D · B | 0.002 | Inv. |
| 1-11 | 92 | 90 | not obs. | D · B | 0.001 | Inv. |
| 1-12 | 88 | 85 | not obs. | D · B | 0.000 | Inv. |
| 1-13 | 96 | 92 | not obs. | D · B | 0.000 | Inv. |
| 1-14 | 93 | 90 | not obs. | D · B | 0.001 | Inv. |

*$S_1$: Sensitivity before storage
$S_2$: Sensitivity after storage
**not obs.: not observed
obs.: observed As can be seen from Table 3, inventive samples were shown to be a silver halide photographic material little in variation of sensitivity after pre-exposure storage and transfer to the screen as stain, rapid-processable, superior in silver image tone, low in fog density after-processing storage and little in variation of photographic performance.

Evaluation of super rapid-processability

In a manner similar to the above, samples were laminated with a fluorescent screen, exposed to X-ray and processed by a modified processor of SRX-503 so as to be processed in the following processing time, using the processing solutions SR-DF at a developing temperature of 35° C. The replenishing rate of the developer or fixer was 125 ml/m$^2$.

The sensitivity was shown as a relative value of reciprocal of the X-ray exposure amount necessary for obtaining a density of a minimum density plus 1.0, based on the sensitivity of Sample 1-1 being 100. Results thereof are shown in Table 3.

| Processing condition: | |
|---|---|
| Developing time | 4 sec. |
| Fixing time | 3.1 sec |
| Washing time | 2 sec |
| Squeeging (washing-drying) | 1.6 sec. |
| Drying time | 4.3 sec |
| Total processing time | 15 sec. |

Evaluation in processing by the use of solid replenisher

According to the following procedure (A) and (B), there was prepared a solid processing composition in the form of a tablet for use as a developer replenisher.

Procedure (A)

Preparation of solid developing composition containing the compound of formula (1)

Preparation of granules (A)

Sodium erythorbate 12500 g, as a developing agent was pulverized in a commercially available mill so as to have an average particle size of 10 μm. To the resulting fine particles, was added sodium sulfite of 2000 g, Dimezone of 2700 g, DTPA of 1250 g, 5-methylbenzotriazole of 12.5 g, 1-phenyl-5-mercaptotetrazole of 4 g and N-acetyl-D,L-penicillamine of 10 g were added and the mixture was mixed in the mill for 30 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. Thus prepared granules (A) was mixed for 10 min. by making use of a mixer in a room controlled to be not higher than 25° C. and 40% RH. The mixture was compression-tableted so as to have a filling amount of 8.77 g per tablet, by making use of a tableting machine that was modified model of Tough Press Collect 1527HU manufactured by Kikusui Mfg. Works, Inc. Thereby, 2500 tablets (A) for use as developer replenishment were prepared.

Procedure (B)

Potassium carbonate of 4000 g, mannit of 2100 g. and polyethylene glycol 6000 of 2100 g were pulverized and granulated in a manner similar to the procedure (A). Added water was 30 ml and after granulation, the resulting granules were dried up at 50° C. for 30 min. so that the moisture content of the granules was almost completely removed off. The mixture was compression-tableted so as to have a filling amount of 3.28 g per tablet, by making use of a tableting machine that was modified model of Tough Press Collect 1527HU manufactured by Kikusui Mfg. Works, Inc. Thereby, 2500 tablets (B) for use in developer replenishment were prepared.

According to the following procedure, there was prepared a solid processing composition in the form of a tablet for use as a fixer replenisher.

Procedure (C)

Ammonium thiosulfate/sodium thiosulfate (70/30 by weight ratio) of 14000 g and sodium sulfite of 1500 g were pulverized in a manner similar to (A) and uniformly mixed by a commercially available mixer. Then, water of 500 ml was added and granulation was carried out in a manner similar to (A). The resulting granules were dried at 60° C. for 30 min. so that the moisture content of the granules was almost completely removed off. To the granules, sodium N-lauroylalanine of 4 g was added and thus prepared granules (A) was mixed for 10 min. by making use of a mixer in a room controlled to be not higher than 25° C. and 40% RH. The mixture was compression-tableted so as to have a filling amount of 6.202 g per tablet, by making use of a tableting machine that was modified model of Tough Press Collect 1527HU manufactured by Kikusui Mfg. Works, Inc. Thereby, 2500 tablets (C) for use as fixer replenishment were prepared.

Procedure (D)

Boric acid of 1000 g, aluminium sulfate of 1500 g, sodium hydrogen acetate (equimolar mixture of glacial acetic acid and sodium acetate) of 3000 g and tartaric acid of 200 g were pulverized and granulated in a manner similar to the procedure (A). Added water was 100 ml and after granulation, the resulting granules were dried up at 50° C. for 30 min. so that the moisture content of the granules was almost completely removed off. To the granules, sodium N-lauroylalanine of 4 g was added. The mixture was compression-tableted so as to have a filling amount of 4.562 g per tablet, by making use of a tableting machine that was modified model of Tough Press Collect 1527HU manufactured by Kikusui Mfg. Works, Inc. Thereby, 1250 tablets (D) for use as fixer replenishment were prepared.

| Starter of developer: | |
|---|---|
| Glacial acetic acid | 2.98 g |
| KBr | 4.0 g |
| Water to make | 1 liter |

-continued

| Processing condition: | | |
|---|---|---|
| Washing | Ordinary temperature | 4.5 sec. |
| Squeegee | | 1.6 sec. |
| Drying | 40° C. | 5.7 sec. |
| | Total | 25 sec. |

TABLE 4

| | Super rapid-processing | | | | Tablet-replenishment | | | |
|---|---|---|---|---|---|---|---|---|
| | After storage | | | | After storage | | | |
| Sample No. | Sensitivity($S_1$) | Smudge | Image tone | Fog | Sensitivity($S_1$) | Image tone | Fog | Remarks |
| 1-1 | 100 | not obs. | Y · Bl | 0.000 | 100 | Y · Bl | 0.000 | Comp. |
| 1-2 | 52 | obs. | R · Bl | 0.006 | 50 | R · Bl | 0.006 | Comp. |
| 1-3 | 82 | not obs. | G · Bl | 0.012 | 74 | G · Bl | 0.012 | Comp. |
| 1-4 | 69 | obs. | N · Bl | 0.011 | 67 | N · Bl | 0.012 | Comp. |
| 1-5 | 96 | not obs. | N · Bl | 0.001 | 94 | N · Bl | 0.000 | Inv. |
| 1-6 | 88 | not obs. | N · Bl | 0.001 | 87 | N · Bl | 0.000 | Inv. |
| 1-7 | 92 | not obs. | N · Bl | 0.001 | 90 | N · Bl | 0.000 | Inv. |
| 1-8 | 93 | not obs. | N · Bl | 0.001 | 92 | N · Bl | 0.000 | Inv. |
| 1-9 | 86 | not obs. | D · B | 0.002 | 84 | D · B | 0.002 | Inv. |
| 1-10 | 85 | not obs. | D · B | 0.002 | 83 | D · B | 0.002 | Inv. |
| 1-11 | 84 | not obs. | D · B | 0.001 | 83 | D · B | 0.002 | Inv. |
| 1-12 | 89 | not obs. | D · B | 0.001 | 88 | D · B | 0.000 | Inv. |
| 1-13 | 96 | not obs. | D · B | 0.000 | 95 | D · B | 0.000 | Inv. |
| 1-14 | 92 | not obs. | D · B | 0.001 | 90 | D · B | 0.000 | Inv. |

At the start of processing (running-processing), a developing solution which was prepared by dissolve 140 tablet of each of developer-replenishing compositions A and B in water to make 16.5 liters and further add thereto the above-described starter of 330 ml was filled in a developer tank. The pH of the developing solution at the start was 10.4.

Photographic material samples each were exposed so as to give a density of 1.0 and subjected to running-processing. The running-processing was carried out a processor SRX-502 which was provided with a solid processing chemicals-supplying member and modified so as to process in a total time of 25 sec.

During running-processing, the developer-replenishing compositions A and B, each 2 tablets and water of 76 ml per 0.62 $m^2$ of the photographic material were supplied to the developing solution. When the tablets A and B each were dissolved in 38 ml of water, the pH was 10.7. The fixer-replenishing compositions C and D, each 2 tablets and water of 76 ml per 0.62 $m^2$ of the photographic material were supplied to the fixing solution. Supply of water started at the same time as the start of supplying the processing compositions and carried out at a constant speed for 10 min., in proportion to the dissolution speed of the processing composition.

After 200 sheets of each sample with a size of 35.6×35.6 cm which were exposed so as to give a density of 1.0, were continuously processed, each sample was evaluated with respect to the silver image (color) tone, stain of the screen and fog density. Results thereof are shown in Table 4.

| Processing condition: | | |
|---|---|---|
| Developing | 35° C. | 8.2 sec. |
| Fixing | 33° C. | 5 sec. |

As can be seen from Table 4, inventive samples were shown to be superior in the silver image tone, no observable transfer as stain of the screen and low in fog density, even when rapidly processed in a total processing time of 25 sec. In the case when solid developing and fixing compositions in the form of a tablet were employed, similar results were also shown.

Example 2

Preparation of high chloride tabular seed grain emulsion (Em-3)

| Solution A3 | |
|---|---|
| Ossein gelatin | 37.5 g |
| KI | 0.625 g |
| NaCl | 16.5 g |
| Distilled water to make | 7500 ml |
| **Solution B3** | |
| Silver nitrate | 1500 g |
| Distilled water to make | 2500 ml |
| **Solution C3** | |
| KI | 4 g |
| NaCl | 140 g |
| Distilled water to make | 684 ml |
| **Solution D3** | |
| NaCl | 375 g |
| Distilled water to make | 1816 ml |

To solution A3 kept at 40° C. with stirring by a mixing stirrer as described in examined Japanese Patents 58-58288 and 58-58289 were added 684 ml of solution B3 and the total amount of solution C3 for 1 min. The EAg was adjusted to 149 mV and Ostwald ripening was further conducted for 20 min. Thereafter, the residue of solution B3 and the total amount of solution D3 were added for 40 min, while the EAg was kept at 149 mV. After completing the addition, the emulsion was desalted to obtain a seed grain emulsion Em-3. Based on electron microscopic observation, it was proved that the resulting seed grain emulsion (Em-3) was comprised of tabular grains having (100) major faces and according for 60% or more of the total grain projected area, which have a average thickness of 0.07 μm, average diameter of 0.5 and a variation coefficient of grain size of 25%.

Preparation of high chloride emulsion

Using the following four solutions, a high chloride containing tabular grain emulsion was prepared.

| | |
|---|---|
| Solution A4 | |
| Ossein gelatin | 29.4 g |
| $HO—(CH_2CH_2O)_n—[CH(CH_3)CH_2O]_{17}(CH_2CH_2O)_mH$ (n + m = 5 – 7) (10% ethanol aq. solution) | 1.25 ml |
| Seed emulsion Em-3 | 0.98 mol equivalent |
| Distilled water to make | 3000 ml |
| Solution B4 | |
| 3.50N silver nitrate aqueous solution | 2240 ml |
| Solution C4 | |
| NaCl | 455 g |
| Distilled water to make | 2240 ml |
| Solution D4 | |
| 1.75N NaCl aqueous solution used for adjusting AG potential | |

To solution A4 kept at 40° C. with stirring by a mixing stirrer as described in Japanese Patents 58-58288 and 58-58289, were added solutions B4 and C4 by double jet addition at an accelerated flow rate (three time from start to finish), while the Ag potential was controlled at 120 mV by use of solution D4.

After completing the addition, coagulation-washing was conducted to remove soluble salts, using an exemplified polymer coagulant (G-3) as described in JP-A 2-7037. Based on electron microscopic observation of ca. 3,000 grains, it was proved that the resulting emulsion (Em-4) was comprised of tabular grains having (100) major faces, an average diameter of 1.17 μm and an average thickness of 0.12 and accounting for 80% or more of the total grain projected area, and having a variation coefficient of 24%.

Subsequently, to the high chloride containing silver halide emulsion Em-4 kept at 55° C. were added the following amounts of silver iodide fine grains and spectrally sensitizing dyes (C) and (D) in the form of a solid particle dispersion. Thereafter, the following sulfur sensitizer, selenium sensitizer, gold sensitizer and compound (R) were added and chemical ripening was conducted for 90 min. When completing the ripening, a stabilizer, 4-hydroxy-6-methyl- 1,3,3a,7-tetrazaindene (TAI) was added thereto in an appropriate amount. Using this emulsion, an emulsion coating solution was prepared in the same manner as the emulsion coating solution of Example 1, except that the inventive compound represented by formula (1) and comparative compound was varied as shown in Table 5.

Compounds added in the ripening process

Silver iodide fine grain emulsion 5 mmol equivalent

Sensitizing dye (C) 280 mg

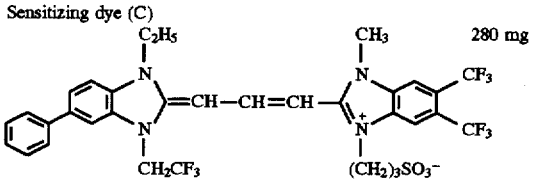

Sensitizing dye (D) 40 mg

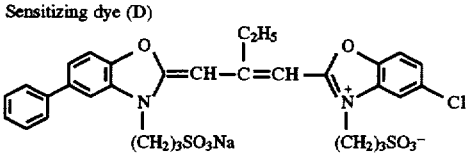

Sulfur sensitizer 2.0 mg

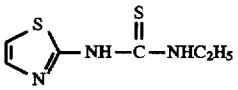

Gold sensitizer 1.0 mg

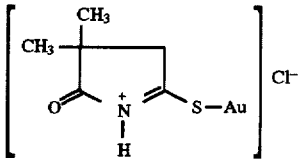

Selenium sensitizer, dimethylselenourea 2.5 mg

Compound (R) 5 mg

Stabilizer (TAI) 50 mg

Coating solutions of a cross-over light shielding layer and a protective layer were each prepared in the same manner as in Example 1, except that the inventive compound represented by formula (1) and comparative compound were varied as shown in Table 5. Thus prepared coating solutions each were coated on both sides of the support and dried in a manner similar to Example 1 to obtain samples as shown in Table 5.

Samples as shown in Table 5 each were exposed, processed and evaluated with respect to rapid-processability and the use of the solid replenisher in a manner similar to Example 1. Results thereof are shown in Table 6.

TABLE 5

| Sample No. | Light Shielding layer Compound (mol/mol Ag) | | Emulsion layer Compound (mol/mol Ag) | | Protective layer Compound (mol/mol Ag) | | Remarks |
|---|---|---|---|---|---|---|---|
| 2-1 | — | — | — | — | — | — | Comp. |
| 2-2 | Comp-1 | $4 \times 10^{-3}$ | — | — | — | — | Comp. |
| 2-3 | Comp-2 | $4 \times 10^{-3}$ | — | — | — | — | Comp. |
| 2-4 | Comp-3 | $4 \times 10^{-3}$ | — | — | — | — | Comp. |
| 2-5 | 9 | $4 \times 10^{-3}$ | — | — | — | — | Inv. |
| 2-6 | — | — | 9 | $4 \times 10^{-3}$ | — | — | Inv. |
| 2-7 | — | — | — | — | 9 | $4 \times 10^{-3}$ | Inv. |
| 2-8 | 18 | $1 \times 10^{-3}$ | 18 | $1 \times 10^{-3}$ | — | — | Inv. |
| 2-9 | 30 | $5 \times 10^{-4}$ | — | — | — | — | Inv. |
| 2-10 | 42 | $2 \times 10^{-4}$ | — | — | — | — | Inv. |
| 2-11 | 58 | $2 \times 10^{-3}$ | — | — | — | — | Inv. |
| 2-12 | 60 | $5 \times 10^{-4}$ | — | — | — | — | Inv. |
| 2-13 | — | — | 70 | $2 \times 10^{-3}$ | — | — | Inv. |
| 2-14 | — | — | 76 | $2 \times 10^{-3}$ | — | — | Inv. |

TABLE 6

| | Super rapid-processing | | | | Tablet-replenishment | | | |
|---|---|---|---|---|---|---|---|---|
| | | After storage | | | After storage | | | |
| Sample No. | Sensitivity($S_1$) | Smudge | Image tone | Fog | Sensitivity($S_1$) | Image tone | Fog | Remarks |
| 2-1 | 100 | not obs. | Y · Bl | 0.000 | 100 | Y · Bl | 0.000 | Comp. |
| 2-2 | 50 | obs. | R · Bl | 0.008 | 49 | R · Bl | 0.008 | Comp. |
| 2-3 | 80 | not obs. | G · Bl | 0.015 | 74 | G · Bl | 0.015 | Comp. |
| 2-4 | 68 | obs. | N · Bl | 0.014 | 65 | N · Bl | 0.014 | Comp. |
| 2-5 | 94 | not obs. | N · Bl | 0.001 | 93 | N · Bl | 0.000 | Inv. |
| 2-6 | 85 | not obs. | N · Bl | 0.001 | 84 | N · Bl | 0.000 | Inv. |
| 2-7 | 90 | not obs. | N · Bl | 0.001 | 89 | N · Bl | 0.000 | Inv. |
| 2-8 | 89 | not obs. | N · Bl | 0.001 | 87 | N · Bl | 0.001 | Inv. |
| 2-9 | 87 | not obs. | D · B | 0.001 | 85 | D · B | 0.001 | Inv. |
| 2-10 | 86 | not obs. | D · B | 0.002 | 85 | D · B | 0.002 | Inv. |
| 2-11 | 89 | not obs. | D · B | 0.001 | 86 | D · B | 0.001 | Inv. |
| 2-12 | 90 | not obs. | D · B | 0.001 | 88 | D · B | 0.001 | Inv. |
| 2-13 | 88 | not obs. | D · B | 0.001 | 87 | D · B | 0.001 | Inv. |
| 2-14 | 91 | not obs. | D · B | 0.001 | 90 | D · B | 0.000 | Inv. |

As can be seen from Table 5, photographic materials with the use of the high chloride emulsion according to the invention were shown to be superior in silver image tone after storage, little in stain of the screen and low in fog density.

Example 3

Preparation of silver bromochloride emulsion Em-5

A silver bromochloride emulsion (Br:Cl=45:55) was prepared in the same manner as emulsion Em-4, except that potassium bromide of 473 g was further added to the solution C4 and the Ag potential was controlled at 100 mV during addition of solutions B4 and C4.

Based on electron microscopic observation of ca. 3,000 grains, it was proved that the resulting emulsion (Em-5) was comprised of tabular grains having (100) major faces, an average diameter of 1.17 μm and an average thickness of 0.12 and accounting for 80% or more of the total grain projected area, and having a variation coefficient of 24%.

Subsequently, to the high chloride containing silver halide emulsion Em-4 kept at 55° C. were added the following amounts of silver iodide fine grains and spectrally sensitizing dyes (C) and (D) in the form of a solid particle dispersion. Thereafter, the following sulfur sensitizer, selenium sensitizer and gold sensitizer were added and chemical ripening was conducted for 80 min. When completing the ripening, a stabilizer, 4-hydroxy-6-methyl-1,3,3a,7-tetrazaindene (TAI) was added thereto in an appropriate amount. Using this emulsion, an emulsion coating solution was prepared in the same manner as the emulsion coating solution of Example 1, except that the inventive compound represented by formula (1) and comparative compound was varied as shown in Table 6.

Compounds added in the ripening process

Silver iodide fine grain emulsion 4 mmol equivalent

Sensitizing dye (C) 200 mg

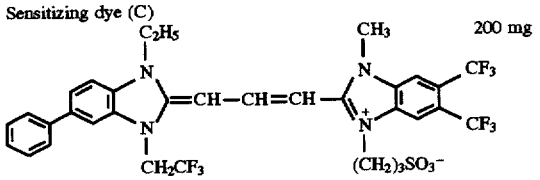

Sensitizing dye (D) 80 mg

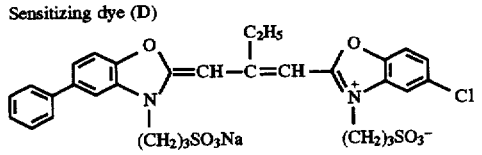

Sulfur sensitizer 2.5 mg

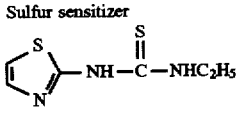

Gold sensitizer 1.0 mg

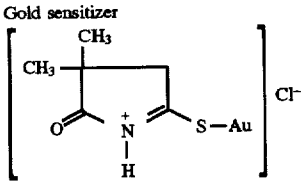

Selenium sensitizer, dimethylselenourea 1.5 mg

Stabilizer (TAI) 45 mg

Coating solutions of a cross-over light shielding layer and a protective layer were each prepared in the same manner as in Example 1. Thus prepared coating solutions each were coated on both sides of the support and dried in a manner similar to Example 1 to obtain samples as shown in Table 7.

The samples were evaluated with respect to the storage stability, screen stain and silver image tone. Results thereof are shown in Tables 8 and 9.

TABLE 7

| Sample No. | Light Shielding layer Compound (mol/mol Ag) | | Emulsion layer Compound (mol/mol Ag) | | Protective layer Compound (mol/mol Ag) | | Remarks |
|---|---|---|---|---|---|---|---|
| 3-1 | — | — | — | — | — | — | Comp. |
| 3-2 | Comp-1 | $3 \times 10^{-3}$ | — | — | — | — | Comp. |
| 3-3 | Comp-2 | $3 \times 10^{-3}$ | — | — | — | — | Comp. |
| 3-4 | Comp-3 | $3 \times 10^{-3}$ | — | — | — | — | Comp. |
| 3-5 | 8 | $3 \times 10^{-3}$ | — | — | — | — | Inv. |
| 3-6 | — | — | 8 | $3 \times 10^{-3}$ | — | — | Inv. |
| 3-7 | — | — | — | — | 8 | $3 \times 10^{-3}$ | Inv. |
| 3-8 | 9 | $1 \times 10^{-3}$ | 9 | $1 \times 10^{-3}$ | — | — | Inv. |
| 3-9 | 19 | $2 \times 10^{-3}$ | — | — | — | — | Inv. |
| 3-10 | 27 | $1 \times 10^{-4}$ | — | — | — | — | Inv. |
| 3-11 | 51 | $3 \times 10^{-4}$ | — | — | — | — | Inv. |
| 3-12 | 57 | $2 \times 10^{-3}$ | — | — | — | — | Inv. |
| 3-13 | — | — | 76 | $2 \times 10^{-3}$ | — | — | Inv. |

TABLE 8

| Sample No. | Sensitivity($S_1$) | After storage $S_2$ | Smudge | Image tone | Fog | Remarks |
|---|---|---|---|---|---|---|
| 3-1 | 100 | 77 | not obs. | Y · Bl | 0.000 | Comp. |
| 3-2 | 52 | 43 | obs. | R · Bl | 0.006 | Comp. |
| 3-3 | 80 | 70 | not obs. | G · Bl | 0.013 | Comp. |
| 3-4 | 68 | 58 | obs. | N · Bl | 0.011 | Comp. |
| 3-5 | 94 | 91 | not obs. | N · Bl | 0.000 | Inv. |
| 3-6 | 86 | 84 | not obs. | N · Bl | 0.000 | Inv. |
| 3-7 | 91 | 88 | not obs. | N · Bl | 0.000 | Inv. |
| 3-8 | 88 | 86 | not obs. | N · Bl | 0.000 | Inv. |
| 3-9 | 86 | 83 | not obs. | N · Bl | 0.001 | Inv. |
| 3-10 | 88 | 85 | not obs. | D · B | 0.001 | Inv. |
| 3-11 | 84 | 81 | not obs. | D · B | 0.000 | Inv. |
| 3-12 | 89 | 87 | not obs. | D · B | 0.001 | Inv. |
| 3-13 | 92 | 90 | not obs. | D · B | 0.000 | Inv. |

TABLE 9

| Sample No. | Super rapid-processing: Sensitivity($S_1$) | After storage: Smudge | Image tone | Fog | Tablet-replenishment: Sensitivity($S_1$) | After storage: Image tone | Fog | Remarks |
|---|---|---|---|---|---|---|---|---|
| 3-1 | 100 | not obs. | Y · Bl | 0.000 | 100 | Y · Bl | 0.000 | Comp. |
| 3-2 | 53 | obs. | R · Bl | 0.007 | 51 | R · Bl | 0.007 | Comp. |
| 3-3 | 81 | not obs. | G · Bl | 0.014 | 76 | G · Bl | 0.014 | Comp. |
| 3-4 | 69 | obs. | N · Bl | 0.012 | 67 | N · Bl | 0.013 | Comp. |
| 3-5 | 95 | not obs. | N · Bl | 0.001 | 93 | N · Bl | 0.000 | Inv. |
| 3-6 | 87 | not obs. | N · Bl | 0.001 | 86 | N · Bl | 0.000 | Inv. |
| 3-7 | 92 | not obs. | N · Bl | 0.001 | 90 | N · Bl | 0.000 | Inv. |
| 3-8 | 89 | not obs. | N · Bl | 0.001 | 87 | N · Bl | 0.000 | Inv. |
| 3-9 | 87 | not obs. | N · Bl | 0.001 | 85 | N · Bl | 0.001 | Inv. |
| 3-10 | 89 | not obs. | D · B | 0.002 | 86 | D · B | 0.002 | Inv. |
| 3-11 | 85 | not obs. | D · B | 0.001 | 82 | D · B | 0.001 | Inv. |
| 3-12 | 89 | not obs. | D · B | 0.001 | 87 | D · B | 0.000 | Inv. |
| 3-13 | 93 | not obs. | D · B | 0.001 | 91 | D · B | 0.000 | Inv. |

As can be seen from Tables 8 and 9, according to the invention, silver halide photographic materials with excellent silver image tone, no transfer to the screen, little variation in photographic performance and low fog density were obtained, even when a high chloride emulsion was used.

What is claimed is:

1. A silver halide photographic light sensitive material comprising a support having thereon photographic component layers including a silver halide emulsion layer and a light insensitive hydrophilic colloidal layer, wherein at least one of the component layers contains a leuco dye represented by the following formula (1):

Formula (1)

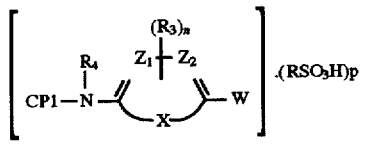

wherein W is —$NR_1R_2$, —OH or —OZ, in which $R_1$ and $R_2$ each are an alkyl group or an aryl group and Z is an alkali metal ion or a quaternary ammonium ion; $R_3$ is a hydrogen atom, a halogen atom or a univalent substituent; n is an integer of 1 to 3; $Z_1$ and $Z_2$ each are a nitrogen atom or =C($R_3$)—; X is an atomic group necessary for forming a 5- or 6-membered aromatic heterocyclic ring; $R_4$ is a hydrogen atom, an acyl group, a sulfonyl group, carbamoyl group, sulfo group, sulfamoyl group, an alkoxycarbonyl group or aryloxycarbonyl group; R is an aliphatic group or an aromatic group; p is an integer of 0 to 2; CP1 is a group represented by the following formulas:

CP1

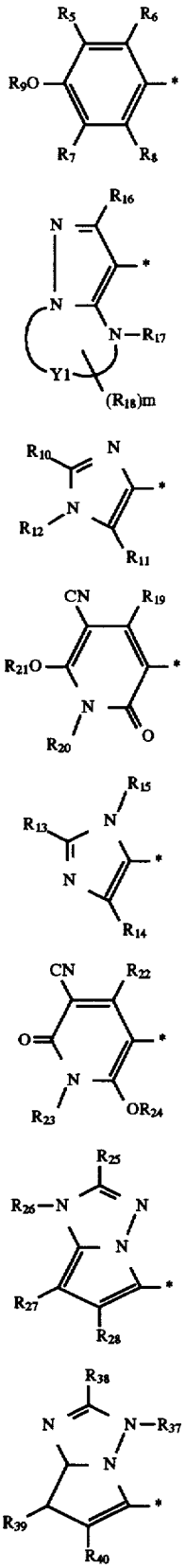

-continued

CP1

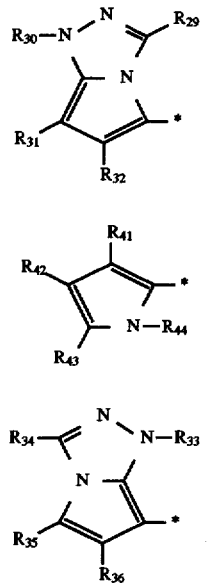

wherein $R_5$ through $R_8$ independently are a hydrogen atom, a halogen atom or a substituent, provided that $R_5$ and $R_6$, or $R_7$ and $R_8$ may form together with each other to form a 5 to 7-membered ring; $R_9$ has the same definition as $R_4$; $R_{10}$ and $R_{11}$ independently are an alkyl group, an aryl group or a heterocyclic group; $R_{12}$ has the same definition as $R_4$; $R_{13}$ and $R_{14}$ each have the same definition of $R_{10}$ and $R_{11}$; $R_{15}$ has the same definition as $R_{12}$; $R_{16}$ is an alkyl group, an aryl group, a sulfonyl group, a trifluoromethyl group, a carboxy group, an aryloxycarbonyl group, an alkoxycarbonyl group, a carbamoyl group or a cyano group; $R_{17}$ has the same definition as $R_4$; $R_{18}$ has the same definition as $R_3$; m is an integer of 1 to 3; Y1 is an atomic group necessary for forming 5- or 6-membered nitrogen containing ring; $R_{19}$ and $R_{20}$ independently are an alkyl group or an aryl group; $R_{21}$ has the same definition as $R_4$; $R_{22}$ and $R_{23}$ each have the same definition as $R_{19}$ and $R_{20}$; $R_{24}$ has the same definition as $R_{21}$; $R_{25}$, $R_{27}$ and $R_{28}$ independently are a hydrogen atom or a substituent; $R_{26}$ has the same definition as $R_4$; $R_{29}$, $R_{31}$ and $R_{32}$ each have the same definition as $R_{25}$, $R_{27}$ and $R_{28}$; $R_{30}$ has the same definition as $R_{26}$; $R_{34}$, $R_{35}$ and $R_{36}$ each have the same definition as $R_{25}$, $R_{27}$ and $R_{28}$; $R_{33}$ has the same definition as $R_{26}$; $R_{38}$, $R_{39}$ and $R_{40}$ each have the same definition as $R_{25}$, $R_{27}$ and $R_{28}$; $R_{37}$ has the same definition as $R_{26}$; $R_{41}$, $R_{42}$ and $R_{43}$ each have the same definition as $R_{25}$, $P_{27}$ and $R_{28}$; $R_{44}$ has the same definition as $R_{26}$; and the symbol, "★" represents a bonding site of CP1 with the other moiety.

2. The silver halide photographic material of claim 1, wherein said compound represented by formula (1) is represented by the following formula (2):

Formula (2)

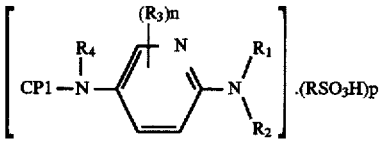

wherein $R_1$, $R_2$, $R_3$ and $R_4$, CP1, n, R and p each have respectively the same definitions as those of $R_1$, $R_2$, $R_3$ and $R_4$, CP1, n, R and p in formula (1).

3. The silver halide photographic material of claim 1, wherein at least one of $R_4$, $R_9$, $R_{12}$, $R_{15}$, $R_{17}$, $R_{21}$, $R_{24}$, $R_{26}$, $R_{30}$, $R_{33}$, $R_{37}$ and $R_{44}$ is substituted by a substituent selected from the group consisting of —$COOM^1$ and —$SO_3M^2$ in which $M^1$ and $M^2$ are each a hydrogen atom or an alkali metal atom.

4. The silver halide photographic material of claim 1, wherein said compound represented by formula (1) is contained in an amount of $1\times10^{-6}$ to $5\times10^{-1}$ mol per mol of silver.

5. The silver halide photographic material of claim 1, wherein, when p is 0 in formula (1), the component layer further contains a compound represented $RSO_3H$, in which R has the same definition as in formula (1).

6. The silver halide photographic material of claim 1, wherein said silver halide emulsion layer comprises silver halide grains having an average silver iodide content of 1 mol % or less, 50% or more of the total grain projected area of the emulsion layer being accounted for by tabular grains having an aspect ratio of 2 to 20.

7. The silver halide photographic material of claim 1, wherein said tabular grains have (100) major faces and an average silver chloride content of 20 to 100 mol %.

8. The silver halide photographic material of claim 1, wherein said silver halide grains are chemically sensitized with a selenium compound or a tellurium compound.

* * * * *